US008723011B2

(12) United States Patent
Matsumoto

(10) Patent No.: US 8,723,011 B2
(45) Date of Patent: May 13, 2014

(54) MUSICAL SOUND GENERATION INSTRUMENT AND COMPUTER READABLE MEDIUM

(75) Inventor: Mitsuhiro Matsumoto, Higashimurayama (JP)

(73) Assignee: Casio Computer Co., Ltd., Tokyo (JP)

( * ) Notice: Subject to any disclaimer, the term of this patent is extended or adjusted under 35 U.S.C. 154(b) by 70 days.

(21) Appl. No.: 13/440,850

(22) Filed: Apr. 5, 2012

(65) Prior Publication Data

US 2012/0255424 A1 Oct. 11, 2012

(30) Foreign Application Priority Data

Apr. 6, 2011 (JP) ..... 2011-084222
Aug. 29, 2011 (JP) ..... 2011-185697

(51) Int. Cl.
*A63H 5/00* (2006.01)
*G04B 13/00* (2006.01)
*G10H 7/00* (2006.01)

(52) U.S. Cl.
USPC ..... 84/609

(58) Field of Classification Search
USPC ..... 84/609–612
See application file for complete search history.

(56) References Cited

U.S. PATENT DOCUMENTS

| | | | | | |
|---|---|---|---|---|---|
| 5,069,104 | A * | 12/1991 | Shibukawa | 84/478 |
| 5,189,237 | A * | 2/1993 | Koguchi | 84/609 |
| 5,286,909 | A * | 2/1994 | Shibukawa | 84/609 |
| 5,367,121 | A * | 11/1994 | Yanase | 84/666 |
| 6,180,865 | B1 * | 1/2001 | Ishiguro | 84/609 |
| 6,600,097 | B2 * | 7/2003 | Shiiya | 84/609 |
| 7,626,109 | B2 | 12/2009 | Katou | |
| 7,633,003 | B2 * | 12/2009 | Usa et al. | 84/609 |

FOREIGN PATENT DOCUMENTS

| | | | |
|---|---|---|---|
| JP | 62-139588 | A | 6/1987 |
| JP | 2000-206965 | A | 7/2000 |
| JP | 2007-114539 | A | 5/2007 |

* cited by examiner

*Primary Examiner* — Jeffrey Donels
(74) *Attorney, Agent, or Firm* — Holtz, Holtz, Goodman & Chick, PC

(57) ABSTRACT

There is provided a musical sound generation instrument. The instrument includes: a storage unit configured to store song data and audio data therein, wherein (a) the song data includes pitches and time information indicating sound generation timing of musical sounds of a song, and (b) the audio data is accompaniment data for the song of the song data; a musical sound data generator configured to generate musical sound data of prescribed musical sounds, based on manipulations of a plurality of playing elements; and an audio data player configured to read and play the audio data according to elapsed time information obtained by the time information included in the song data. The audio data player includes: a manipulation judging unit configured to determine whether manipulation timing of one of the playing elements synchronizes with the sound generation timing of the song data; and a player controller.

10 Claims, 21 Drawing Sheets

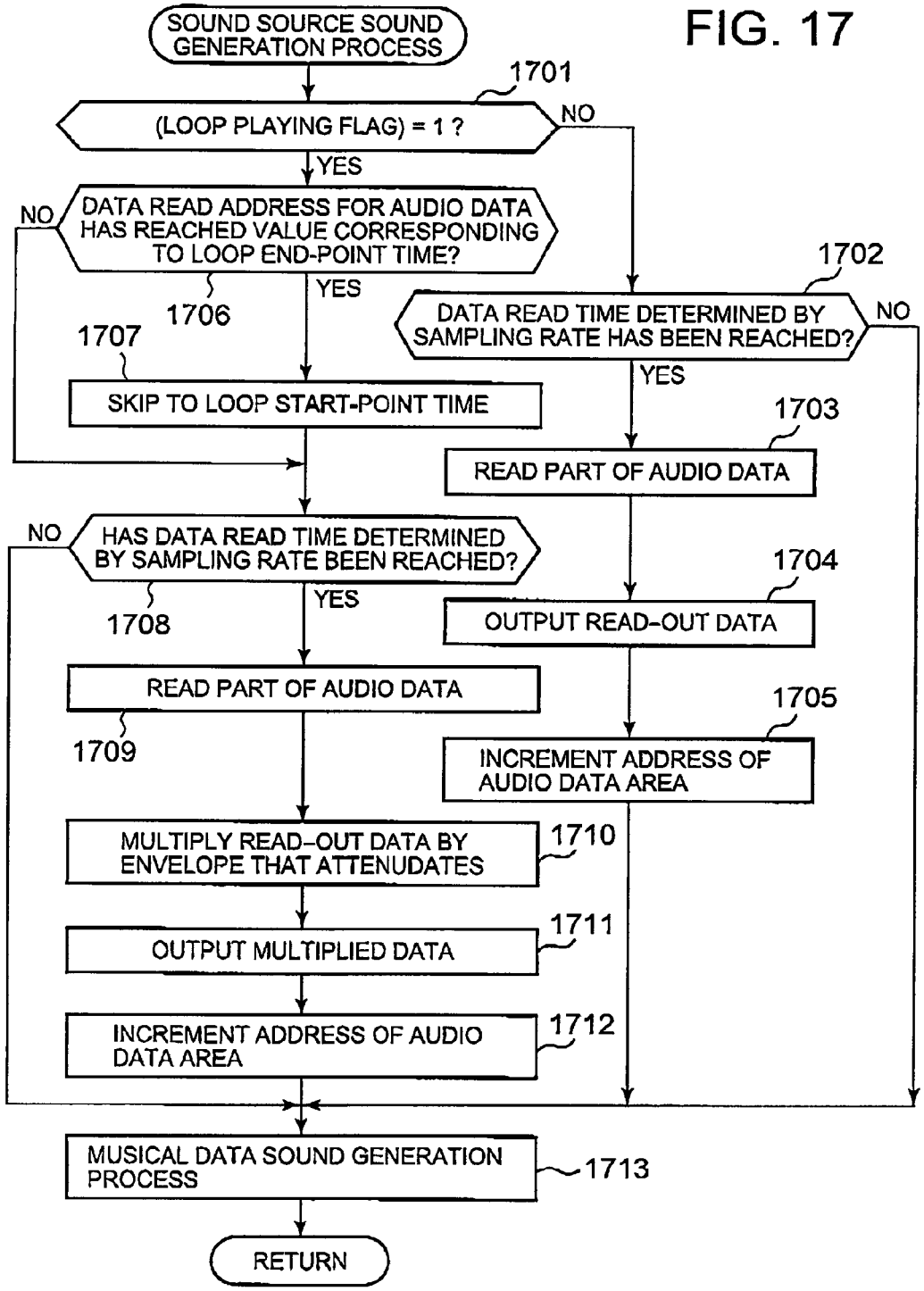
FIG. 17
SOUND SOURCE SOUND GENERATION PROCESS
1701
(LOOP PLAYING FLAG) = 1 ?
NO
YES
NO
DATA READ ADDRESS FOR AUDIO DATA HAS REACHED VALUE CORRESPONDING TO LOOP END-POINT TIME?
1706
YES
1707
SKIP TO LOOP START-POINT TIME
1702
DATA READ TIME DETERMINED BY SAMPLING RATE HAS BEEN REACHED?
NO
YES
1703
READ PART OF AUDIO DATA
NO
HAS DATA READ TIME DETERMINED BY SAMPLING RATE BEEN REACHED?
1708
YES
1704
OUTPUT READ-OUT DATA
READ PART OF AUDIO DATA
1709
1705
INCREMENT ADDRESS OF AUDIO DATA AREA
MULTIPLY READ-OUT DATA BY ENVELOPE THAT ATTENUDATES
1710
OUTPUT MULTIPLIED DATA
1711
INCREMENT ADDRESS OF AUDIO DATA AREA
1712
MUSICAL DATA SOUND GENERATION PROCESS
1713
RETURN

MUSICAL SOUND GENERATION INSTRUMENT AND COMPUTER READABLE MEDIUM

CROSS-REFERENCE TO RELATED APPLICATION

This application claims priority from Japanese Patent Applications No. 2011-084222, filed on Apr. 6, 2011, and No. 2011-185697, filed on Aug. 29, 2011, the entire contents of which are hereby incorporated by reference.

BACKGROUND OF THE INVENTION

1. Field of the Invention

Embodiments described herein relate to a musical sound generation instrument and a computer readable medium in which musical sound data generated by pushing keys and stored audio data cooperate with each other.

2. Description of the Related Art

The function commonly called "automatic accompaniment" is well known in electronic musical instruments. According to a typical automatic accompaniment function, data of an automatic accompaniment pattern of a prescribed song (musical piece) is stored and musical sounds constituting an automatic accompaniment are generated while the stored data are read out sequentially at a prescribed tempo. A player plays a prescribed part (in general, a melody) by pushing keys with timing that is prescribed in the song while listening to the automatic accompaniment, whereby complete musical sounds of the song are generated.

The automatic accompaniment pattern is configured so that musical sounds corresponding to prescribed chords are generated with sound generation timing of a prescribed accompaniment sequence. The automatic accompaniment pattern may include obbligato sounds of a countermelody and rhythm sounds.

Such an automatic accompaniment generates sounds in the same manner as musical sounds that are generated when a player manipulates keys. More specifically, a note-on event including a pitch and a tone is sent to a sound source section with sound generation timing indicated by an automatic accompaniment sequence and the sound source section reads waveform data, that is, reads data of the specified tone at a speed corresponding to the specified pitch, from a ROM which is stored with waveform data, whereby musical sound waveform data of the specified tone and pitch is output.

In an electronic musical instrument having such an automatic accompaniment function, a player is not necessarily skilled in playing of a song; he or she may not be able to push a key with correct timing or may push an erroneous key. JP-A-2000-206965 and 2007-114539 disclose electronic musical instruments which, even in such a case, prevent an event that only the automatic accompaniment advances independently by adjusting the reading of data of an automatic accompaniment pattern.

On the other hand, an electronic musical instrument has been proposed which can reproduce both of musical sound waveform data generated by a sound source section and audio data received from another audio apparatus such as an audio player or audio data produced by sampling an audio signal picked up by a microphone or the like.

For example, an apparatus is conceivable which reproduces such audio data as an automatic accompaniment and reproduces, as melody sounds, musical sound waveform data that is generated by a sound source section based on key manipulations of a player. Since audio data is read out at a fixed sampling frequency, this apparatus has a problem that it is difficult to control the reading of the audio data so that it conforms to a play of a player when he or she cannot push keys with correct timing.

SUMMARY OF THE INVENTION

An object of the present invention is to provide a musical sound generation instrument and a computer readable medium which make it possible to read audio data properly according to key manipulations of a player when the audio data is played as an automatic accompaniment.

According to one or more illustrative aspects of the present invention, there is provided a musical sound generation instrument. The musical sound generation instrument comprises: a storage unit configured to store song data and audio data therein, wherein (a) the song data includes pitches and time information indicating sound generation timing of musical sounds of a song, and (b) the audio data is accompaniment data for the song of the song data; a musical sound data generator configured to generate musical sound data of prescribed musical sounds, based on manipulations of a plurality of playing elements; and an audio data player configured to read and play the audio data according to elapsed time information obtained by the time information included in the song data. The audio data player comprises: a manipulation judging unit configured to determine whether manipulation timing of one of the playing elements synchronizes with the sound generation timing of the song data; and a player controller configured to (a) change a reading position of the audio data from a zero-cross point corresponding to the manipulation timing to a zero-cross point corresponding to the sound generation timing, and then (b) read and play the audio data, when the manipulation judging unit determines that the manipulation timing does not synchronize with the sound generation timing.

According to one or more illustrative aspects of the present invention, there is provided a non-transitory computer-readable storage medium storing a program for controlling a control unit of a musical sound generation instrument that includes: (i) a storage unit configured to store song data and audio data therein, wherein (a) the song data includes pitches and time information indicating sound generation timing of musical sounds of a song, and (b) the audio data is accompaniment data for the song of the song data; and (ii) a musical sound data generator configured to generate musical sound data of prescribed musical sounds, based on manipulations of a plurality of playing elements, and The program controls the control unit to perform functions of: (a) determining whether manipulation timing of one of the playing elements synchronizes with the sound generation timing of the song data; (b) changing a reading position of the audio data from a zero-cross point corresponding to the manipulation timing to a zero-cross point corresponding to the sound generation timing; and (c) reading and playing the audio data, when determining that the manipulation timing does not synchronize with the sound generation timing.

Other aspects and advantages of the present invention will be apparent from the following description, the drawings and the claims.

BRIEF DESCRIPTION OF THE DRAWINGS

FIG. 17 is a flowchart of an example sound source sound generation process according to the embodiment;

DETAILED DESCRIPTION

Figure 1:
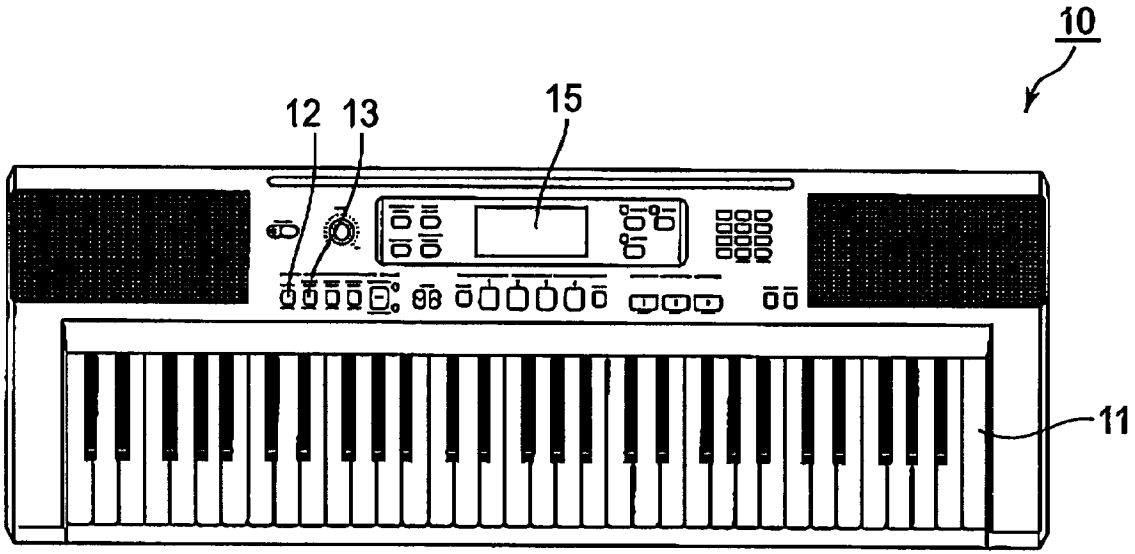
FIG. 1 shows an appearance of an electronic musical instrument according to an embodiment of the present invention.

An embodiment of the present invention will be hereinafter described with reference to the accompanying drawings. FIG. 1 shows an appearance of an electronic musical instrument 10 according to the embodiment. As shown in FIG. 1, the electronic musical instrument 10 according to the embodiment is equipped with a keyboard 11. Switches 12, 13, etc. for specifying a tone, stating or stopping an accompaniment that is based on audio data (described later), and serving for other purposes and a display unit 15 for displaying various kinds of information (e.g., a tone or part of a score) relating to a song to be played are disposed behind the keyboard 11. The electronic musical instrument 10 according to the embodiment has 61 keys (C2-C7), for example.

Figure 2:
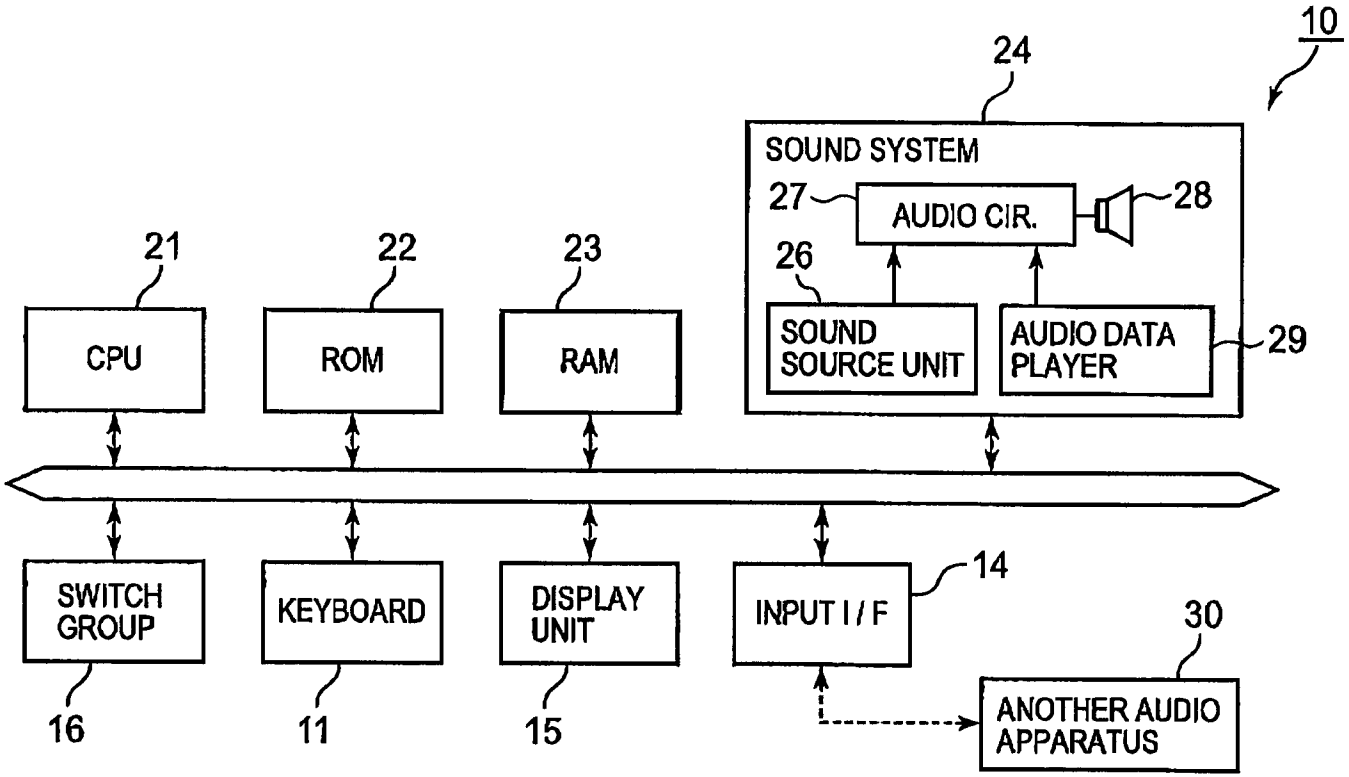
FIG. 2 is a block diagram showing the configuration of the electronic musical instrument according to the embodiment.

FIG. 2 is a block diagram showing the configuration of the electronic musical instrument 10 according to the embodiment of the invention. As shown in FIG. 2, the electronic musical instrument 10 according to the embodiment is equipped with a CPU 21, a ROM 22, a RAM 23, a sound system 24, the keyboard 11, an input interface (I/F) 14, the display unit 15, and a switch group 16 including the above-mentioned switches 11 and 12.

The CPU 21 controls the entire electronic musical instrument 10 and performs various kinds of processing such as detection of pushes of keys of the keyboard 11 or a manipulation of a switch of the switch group 16, control of the sound system 24 according to a key or switch manipulation, and an accompaniment that is based on audio data.

The ROM 22 is stored with programs of various processes to be executed by the CPU 21, such as a process to be executed in response to a manipulation of a switch, generation of a musical sound in response to a push of a key of the keyboard 11, and an accompaniment to be performed according to audio data. The ROM 22 has a waveform data area which is stored with waveform data for generation of musical sounds of various tones of the piano, violin, guitar, trumpet, clarinet, etc., a song data area which is stored with song data each including data of keys to be pushed and push timing, and an audio data area which is stored with audio data. The RAM 23 stores programs that are read from the ROM 22 and data that are generated during processing. The RAM 23 also has an audio data area for storing audio data that is received from another audio apparatus 30 via the input I/F 14. Audio data is, for example, PCM data acquired through sampling at a prescribed sampling frequency, and data values are stored sequentially from a start address of the audio data area.

The input I/F 14 can be connected to another audio apparatus 30 and can receive audio data from the other audio apparatus 30. Audio data is stored in the audio data area of the RAM 23 via the CPU 21. Audio data is correlated with elapsed times as measured with respect to data stored at a bead address.

The sound system 24 is equipped with a sound source section 26, an audio circuit 27, speakers 28, and an audio data player 29. When receiving, for example, information relating to a pushed key or information relating to an automatic accompaniment pattern from the CPU 12, the sound source section 26 reads prescribed waveform data from the waveform data area of the ROM 22 and generates and outputs musical sound data of a prescribed pitch. The sound source section 26 can output waveform data (in particular, waveform data having a tone of a percussion instrument such as a snare drum, a bass drum, or cymbals) as it is as musical sound data. The audio data player 29 reads audio data stored in the audio data area according to the sampling frequency or elapsed times that are based on time information included in song data. As described later, the audio data player 29 can receive two loop points (loop start-point time and loop end-point time) and perform audio data loop playing of audio data between the two loop points. The audio circuit 27 combines musical sound data and audio data and D/A converts and amplifies combined data. A resulting audio signal is output from the speakers 28.

Figure 3:
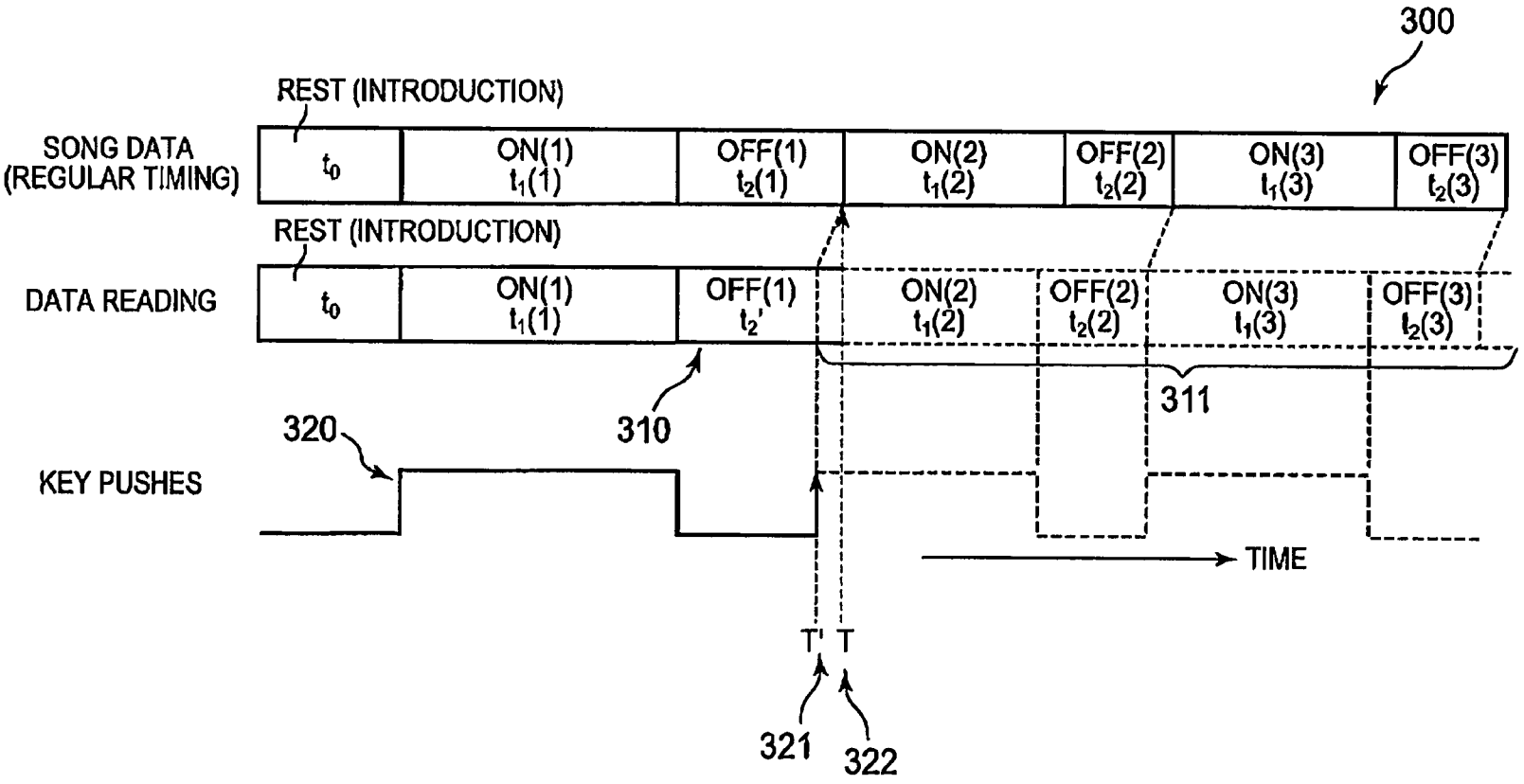
FIG. 3 shows an example relationship between song data and key push timing when an accompaniment is performed according to the embodiment.
Figure 4:
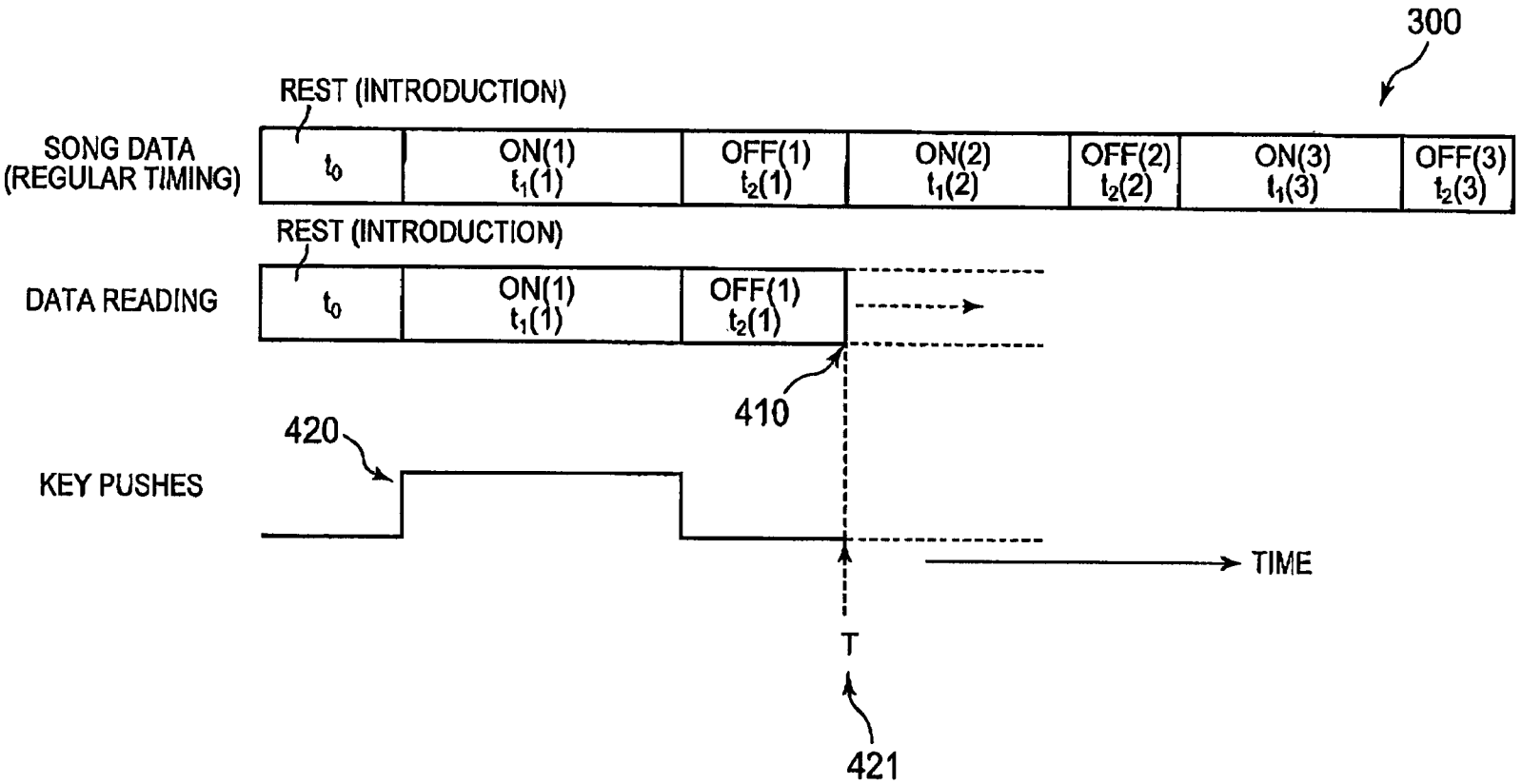
FIG. 4 shows another example relationship between song data and key push timing when an accompaniment is performed according to the embodiment.
Figure 5:
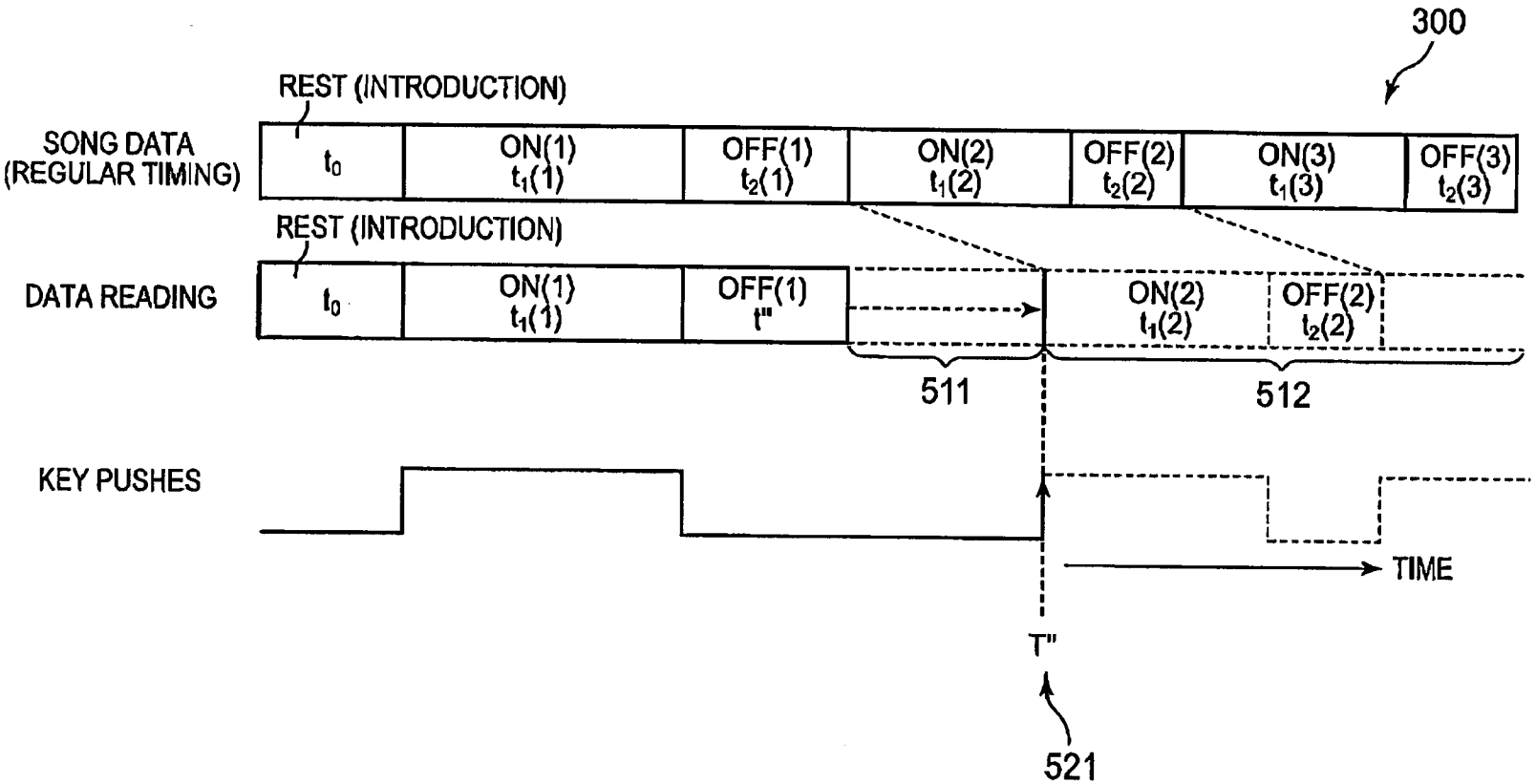
FIG. 5 shows a further example relationship between song data and key push timing when an accompaniment is performed according to the embodiment.

FIGS. 3-5 show example relationships between song data and key push timing when an accompaniment is performed according to the embodiment. As shown in FIG. 3, in song data of regular timing, a key is supposed to be pushed (key on) after a first rest (duration $t_0$), the finger is supposed to be released from that key after duration $t_1$(1), and the next key is supposed to be pushed (duration $t_1$(2)) after duration $t_2$(1). In actual key push manipulations 320, a push of a first key and a release from the first key are done correctly. However, whereas the next key should be pushed at time T (denoted by symbol 322) after a lapse of duration $t_2(1)$ from the release from the first key, actually the next key is pushed at time T' (denoted by symbol 321) after a lapse of duration $t_2'$ (denoted by symbol 310) ($t_2'<t_2(1)$). That is, the next key is pushed earlier by T−T' ($=t_2(1)-t_2'$). Therefore, from this time onward, it is necessary to advance the reading of the song data by T−T' (indicated by symbol 311).

Also in the example of FIG. 4, in actual key push manipulations 420, a push of a first key and a release from the first key are done correctly. However, in the example of FIG. 4, the next key is not pushed (indicated by symbol 410) even after a lapse of duration $t_2(1)$ after the release from the first key. For example, assume that as shown in FIG. 5 the next key is pushed at time T" (denoted by symbol 521) after a lapse of duration t" ($>t_2(1)$) from the release from the first key. In this case, the push of the next key is delayed by $t''-t_2(1)$. Therefore, from this time onward, it is necessary to delay the reading of the song data by $t''-t_2(1)$ (indicated by symbol 512). In a period 511, data having a new address of audio data cannot be read out.

In the embodiment, as described later, whereas generation of musical sounds by key pushes is performed by the sound source section 26, an accompaniment is realized by generation of audio data. Therefore, as shown in FIG. 3 or 5, if a key push is done earlier or later, it is necessary to adjust the reading of the audio data. In the embodiment, this is done by a method to be described later.

Figure 6A:
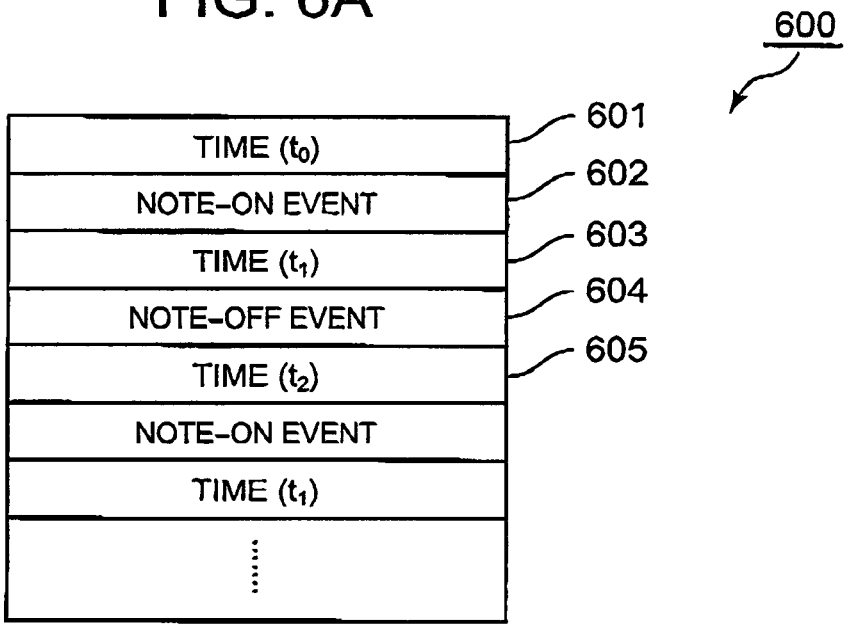
FIG. 6A shows an example data structure of song data according to the embodiment.
Figure 6B:
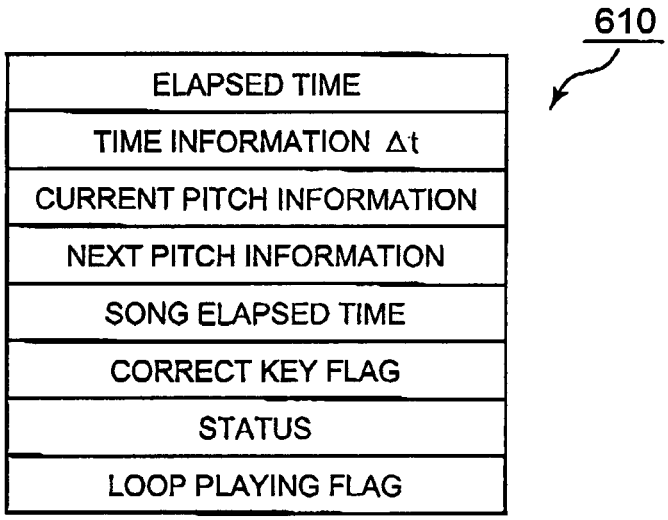
FIG. 6B shows an example register group for storing data that are set during processing.

FIG. 6A shows an example data structure of song data according to the embodiment. FIG. 6B shows an example register group 610 for storing data that are set during processing. As shown in FIG. 6A, song data 600 includes time records 601, 603, 605, etc. indicating durations, records 602 etc. of note-on events each including a pitch of a key to be pushed, and records 604 etc. of note-off events each including a pitch of a key from which a finger is to be released.

The first time record 601 contains a duration $t_0$ to a first key push. The duration $t_0$ corresponds to a duration of an introduction of the song. A durations $t_1$ contained in a time record between a preceding note-on event and a following note-off event indicates a key push duration. A durations $t_2$ contained in a time record between a preceding note-off event and a following note-on event indicates a duration from a release from a certain key to a push of the next key.

As shown in FIG. 6B, the register group 610 which provided in the RAM 23 has an elapsed time register, a time information register, a current pitch information register, a next pitch information register, a song elapsed time register, a correct key flag, a status register, and a loop playing flag. The elapsed time register stores an elapsed time between song processes. The time information register stores a time period $\Delta t$ ($=t_1+t_2$) between note-on events. Each of the current pitch information register and the next pitch information register stores pitch information that is contained in the record of the corresponding note-on event. The song elapsed time register stores an elapsed time from a start of a song. The status register stores a play status of the electronic musical instrument 10.

Figure 7A:
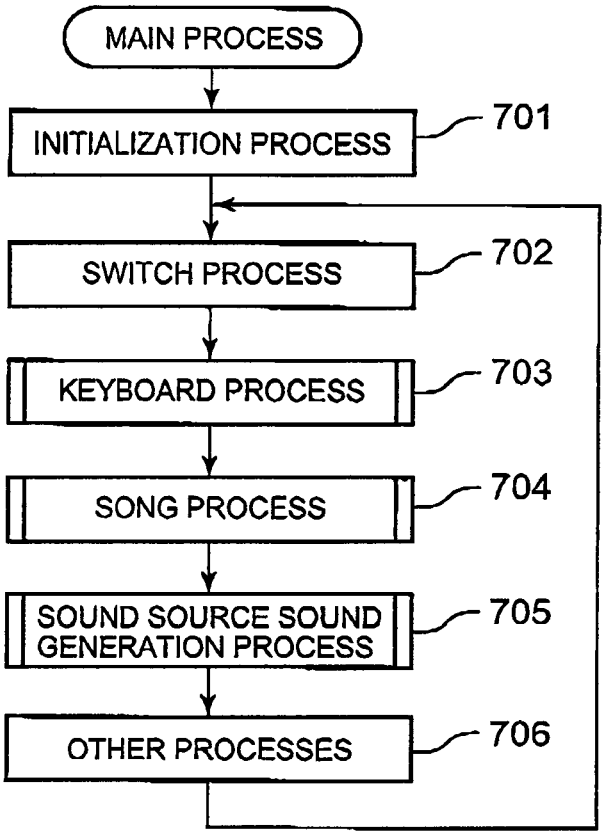
FIG. 7A is a flowchart of an example main process which is executed in the electronic musical instrument according to the embodiment.
Figure 7B:
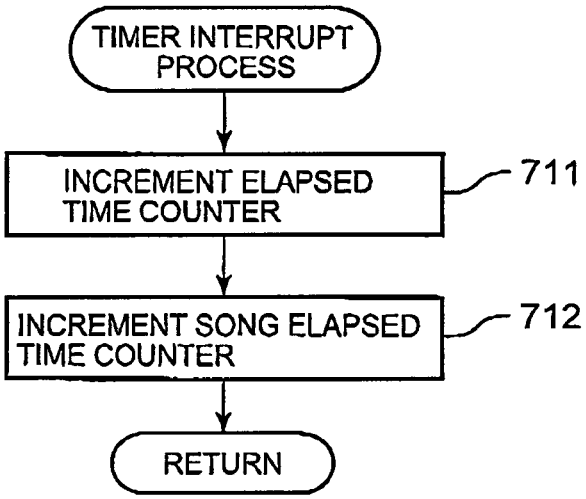
FIG. 7B is a flowchart of an example timer interrupt process according to the embodiment.

Processes which are executed in the electronic musical instrument 10 according to the embodiment will be described below. FIG. 7A is a flowchart of an example main process which is executed in the electronic musical instrument 10 according to the embodiment. FIG. 7B is a flowchart of an example timer interrupt process according to the embodiment In the timer interrupt process, while the main process of FIG. 7A is being executed, the count of each of an elapsed time counter and a song elapsed time counter which are interrupt counters is incremented every prescribed time period (steps 711 and 712). In the timer interrupt process, each counter can be stopped according to an instruction from the CPU 21.

As shown in FIG. 7A, upon power-on of the electronic musical instrument 10, at step 701 the CPU 21 of the electronic musical instrument 10 executes an initialization process which includes clearing of the data stored in the RAM 23 and the image being displayed on the display unit 15. At step 702, the CPU 21 executes a switch process, that is, detects manipulations, if any, performed on the respective switches of the switch group 16 and performs processing corresponding to a manipulation-detected switch.

For example, at step 702 (switch process), a manipulation of a tone specifying switch, a switch for specifying song data for an accompaniment, or a song playing switch is detected. For example, if the song playing switch is turned on, the CPU 21 stores a prescribed value in the status register of the register group 610. If the song playing switch is turned off, the CPU 21 stores a value indicating a song playing off state in the status register.

Figure 8:
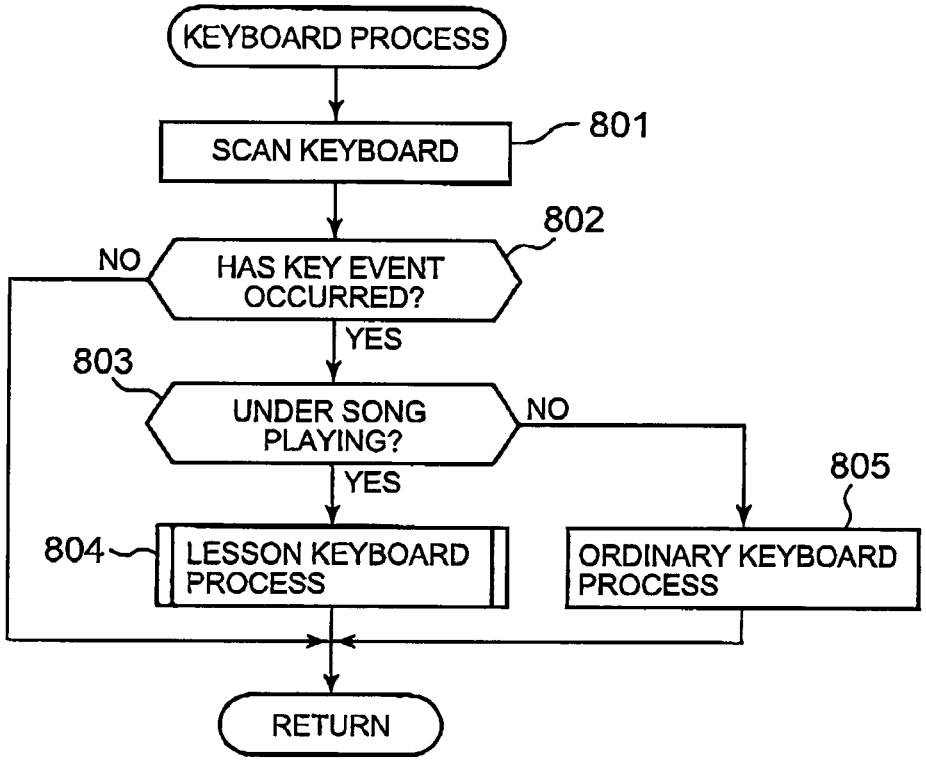
FIG. 8 is a flowchart showing the details of an example keyboard process according to the embodiment.

Upon completion of step 702 (switch process), the CPU 21 executes a keyboard process at step 703. FIG. 8 is a flowchart showing the details of an example keyboard process according to the embodiment. In the keyboard process, at step 801, the CPU 21 scans the keys of the keyboard 11. An event (note-on event or note-off event) as a key scanning result is stored in the RAM 23 temporarily. At step 802, the CPU 21 determines whether or not a new event has occurred for a certain key by referring to the key scanning result stored in the RAM 23. If the determination result of step 802 is affirmative, at step 803 the CPU 21 determines whether or not the play status is "under song playing" by referring to the status register.

If the determination result of step 803 is affirmative, at step 804 the CPU 21 executes a lesson keyboard process. On the other hand, if the determination result of step 803 is negative, the CPU 21 executes an ordinary keyboard process at step 805. At step 805, the CPU 21 determines whether the key event is note-on (key push) or note-off (key release). If the key event is note-on, the CPU 21 generates a note-on event including pitch information of the pushed key and outputs it to the sound source section 26. If the key event is note-off, the CPU 21 generates a note-off event including pitch information of the released key and outputs it to the sound source section 26.

Figure 9:
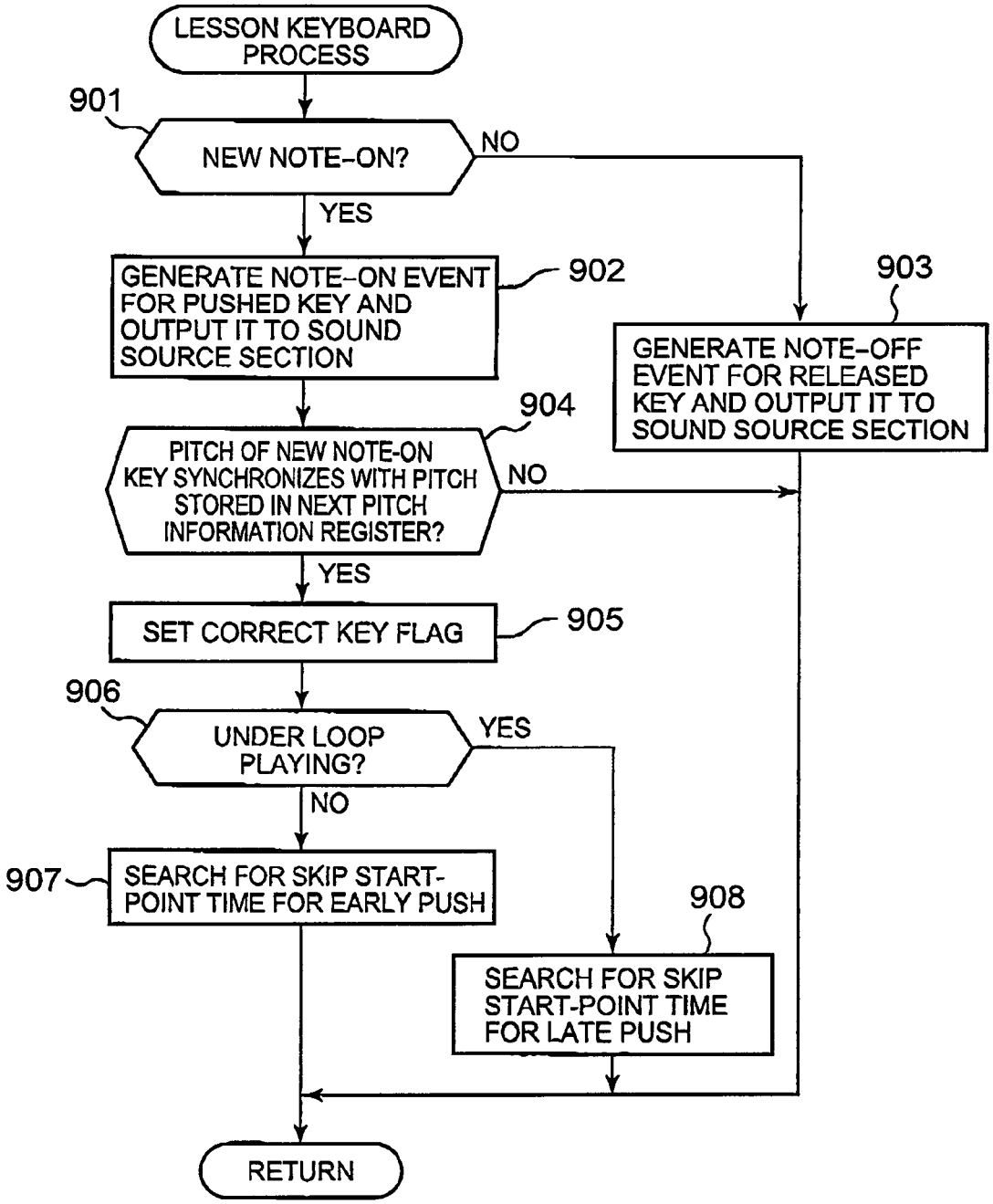
FIG. 9 is a flowchart of an example lesson keyboard process according to the embodiment.

Next, the lesson keyboard process (step 804) will be described. FIG. 9 is a flowchart of an example lesson keyboard process according to the embodiment. As shown in FIG. 9, at step 901, the CPU 21 determines whether or not the key event is new note-on. If the determination result of step 901 is affirmative, at step 902 the CPU 21 generates a note-on event including pitch information of the pushed key and outputs it to the sound source section 26. If the determination result of step 901 is negative, at step 903, the CPU 21 generates a note-off event including pitch information of the released key and outputs it to the sound source section 26. Then, the lesson keyboard process is finished.

Upon execution of step 902, at step 904 the CPU 21 determines whether or not the pitch of the new note-on key synchronizes with the pitch that is stored in the next pitch information register. If the determination result of step 904 is negative, the lesson keyboard process is finished. If the determination result of step 904 is affirmative, at step 905 the CPU 21 sets the correct key flag of the register group 610 to "1." The correct key flag is set to "1" if a key that has been pushed by a player synchronizes with a key to be pushed next.

At step 906, the CPU 21 determines whether or not audio data as accompaniment data is under loop playing. This may be done by determining whether or not the loop playing flag of the register group 610 is "1." If the determination result of step 906 is negative, at step 907 the CPU 21 searches for a skip start-point time for an early push. If the determination result of step 906 is affirmative, at step 908 the CPU 21 searches for a skip start-point time for a late push. The skip start-point time is a zero-cross point of a prescribed phase (e.g., a negative-to-positive data value change) that is closest to the key push timing on its future side in time series.

Figure 10:
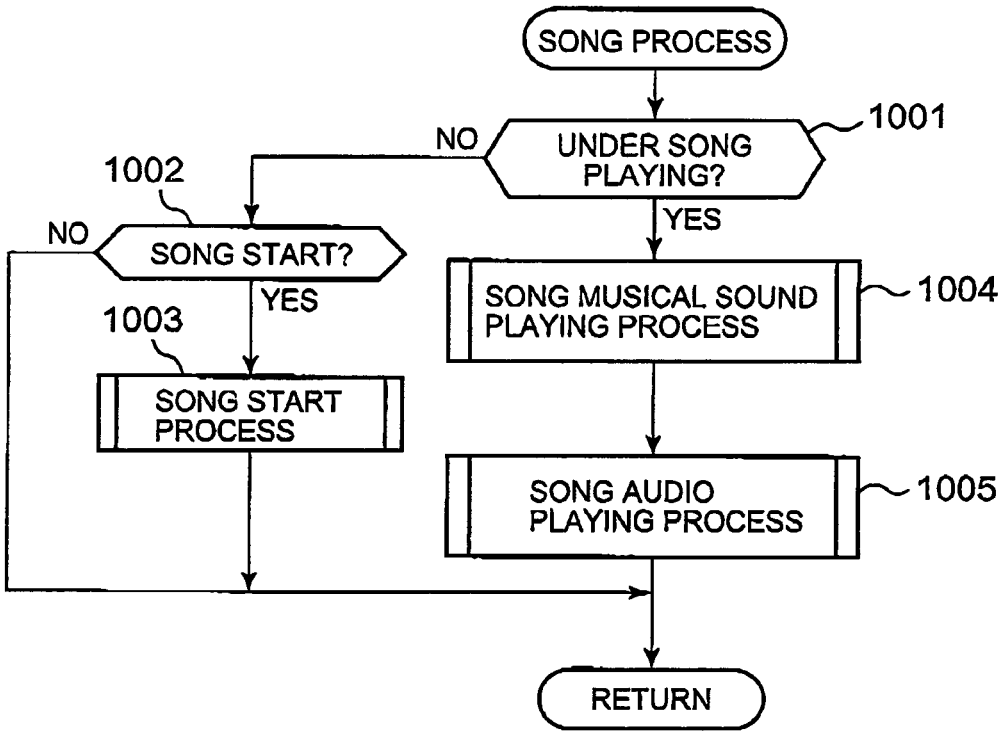
FIG. 10 is a flowchart of an example song process according to the embodiment.

Upon completion of step 703 (keyboard process), the CPU 21 executes a song process at step 704. FIG. 10 is a flowchart of an example song process according to the embodiment. As shown in FIG. 10, at step 1001, the CPU 21 determines whether or not the play status is "under song playing" by referring to the status register. If the determination result of step 1001 is negative, at step 1002 the CPU 21 determines whether or not the play status is "song start" by referring to the status register. If the determination result of step 1002 is negative, the song process is finished. If the determination result of step 1002 is affirmative, at step 1003 the CPU 21 executes a song start process.

Figure 11:
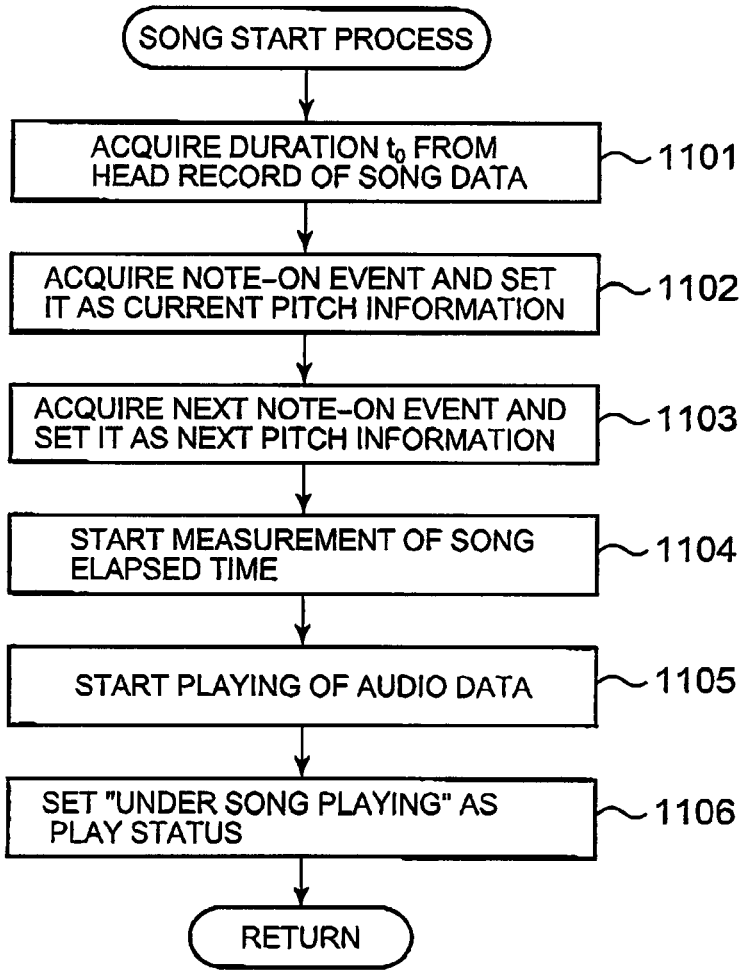
FIG. 11 is a flowchart of an example song start process according to the embodiment.

FIG. 11 is a flowchart of an example song start process according to the embodiment. As shown in FIG. 11, at step 1101, the CPU 21 acquires duration $t_0$ from the head record of song data that is stored in the ROM 22. Duration to is stored in the time information register of the register group 610 as initial time information Δt. At step 1102, the CPU 21 acquires a note-on event from the record at the next address and stores, in the current pitch information register, the pitch information included in the acquired note-on event. At step 1103, the CPU 21 acquires a note-on event from the next record and stores, in the next pitch information register, the pitch information included in the acquired next note-on event.

At step 1104, the CPU 21 permits operation of the song elapsed time counter of the timer interrupt process and starts measurement of a song elapsed time. At step 1105, the CPU 21 instructs the audio data player 29 to start playing of audio data. At step 1106, the CPU 21 stores information indicating "under song playing" in the status register as a play status.

Figure 12:
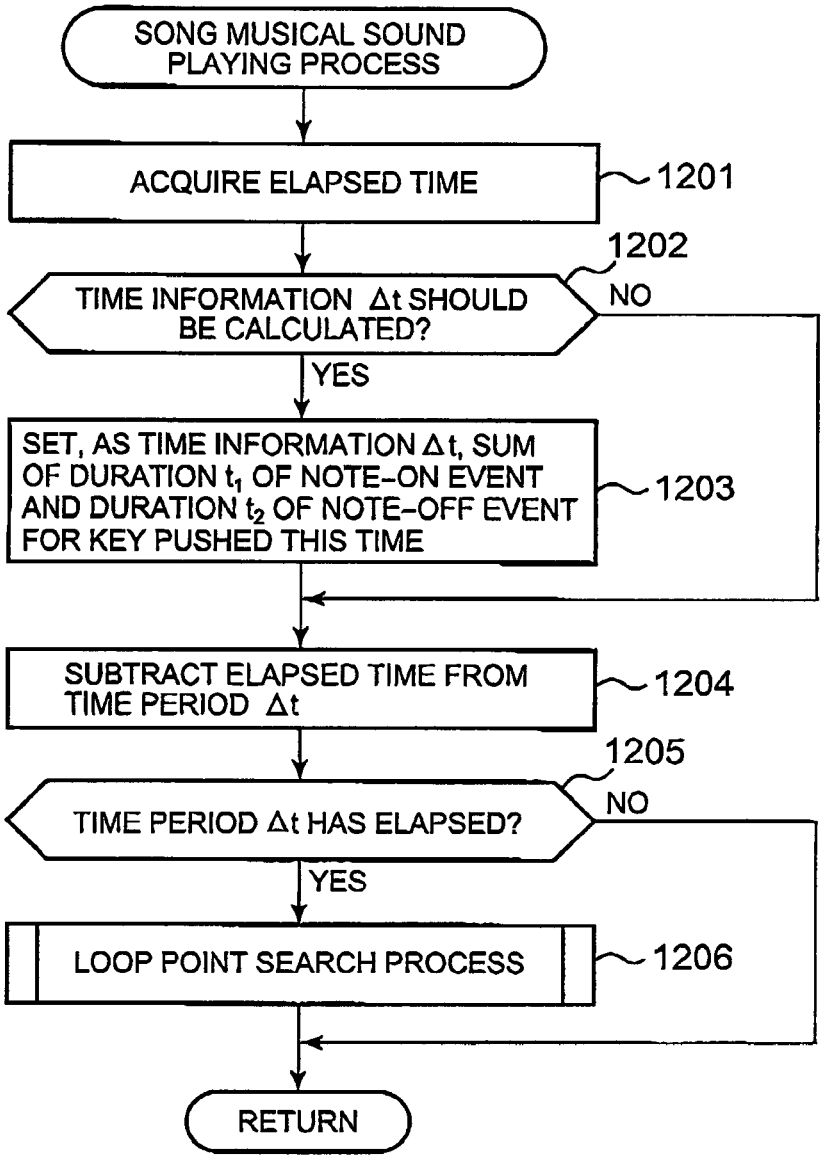
FIG. 12 is a flowchart of an example song musical sound playing process according to the embodiment.

If the determination result of step 1001 is affirmative, at step 1004 the CPU 21 executes a song musical sound playing process. FIG. 12 is a flowchart of an example song musical sound playing process according to the embodiment. As shown in FIG. 12, at step 1201, the CPU 21 acquires a register value of the elapsed time register. At step 1202, the CPU 21 determines whether to calculate time information Δt. If the determination result of step 1202 is affirmative, at step 1203 the CPU 21 adds together duration $t_1$ that is contained in the record next to the record of the note-on event for the key pushed this time and duration $t_2$ contained in the record next to the record of note-off event for the same key and stores an addition value $t_1+t_2$ in the time information register as time information Δt. It is determined at step 1202 that time period Δt should be calculated if the values of the current pitch information register and the next pitch information register have been changed.

At step 1204, the CPU 21 subtracts the elapsed time from the time period Δt. Steps 1201-1204 serve to determine whether or not the elapsed time from the time of the preceding key push (note-on) has reached the time period Δt and the time of the next key push (note-on) has been reached. If it is determined at step 1205 by referring to the result of step 1204 that the time period Δt has elapsed from the time of the preceding key push (step 1205: yes), it means that the key to be pushed next has not been pushed yet though the time to do so has already been reached. Therefore, if the determination result of step 1205 is affirmative, at step 1206 the CPU 21 executes a loop point search process.

Figure 13:
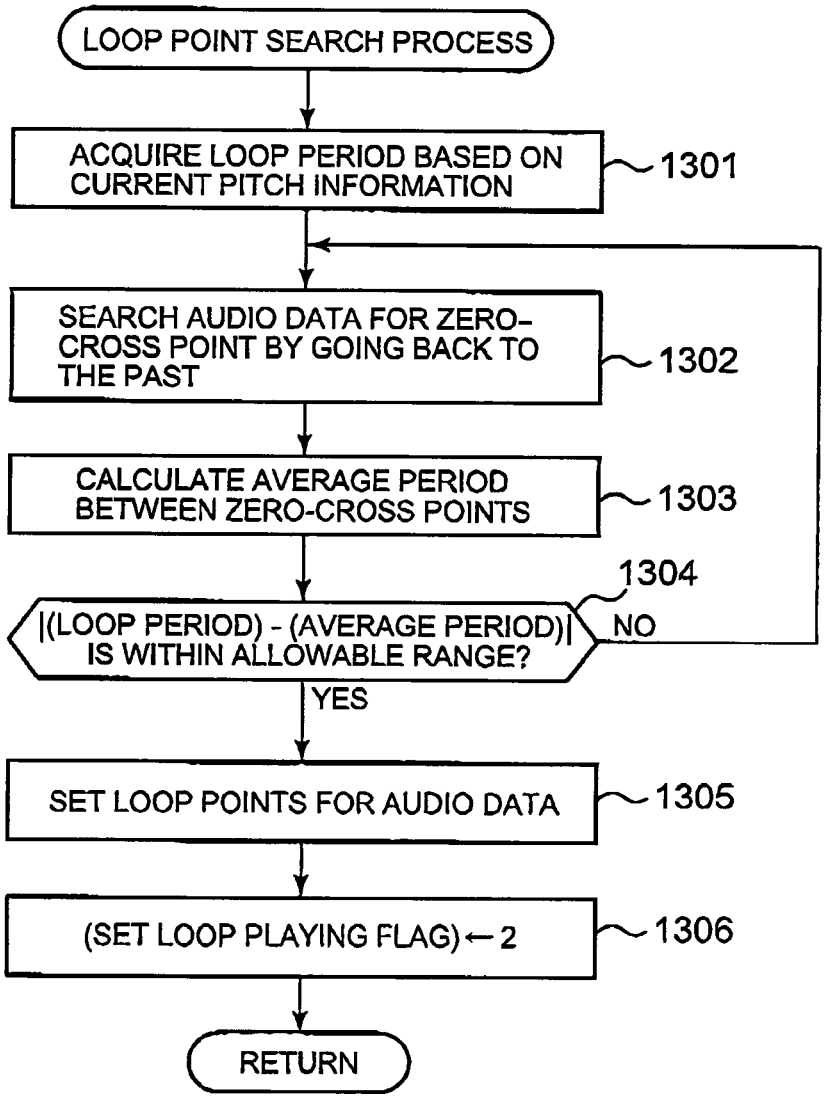
FIG. 13 is a flowchart of an example loop point search process according to the embodiment.

FIG. 13 is a flowchart of an example loop point search process according to the embodiment. As shown in FIG. 13, at step 1301, the CPU 21 calculates a loop period which is a period of the pitch concerned based on the current pitch information stored in the current pitch information register. This loop period is made a basic period of a loop of audio data. At step 1302, the CPU 21 searches the audio data for a zero-cross point by going back to the past from the current playing address. At step 1303, the CPU 21 calculates an average period between the zero-cross points. The CPU 21 searches for zero-cross points having the same phase. That is, if a zero-cross point that is found first is a rise zero-cross point (the data value changes from negative to positive), only rise zero-cross points are to be searched for thereafter.

At step 1304, the CPU 21 determines whether or not the absolute value of the difference between the loop period and the average period is within an allowable range (i.e., smaller than a prescribed threshold value). If the determination result of step 1304 is negative, at step 1302 the CPU 21 searches the audio data for the next zero-cross point by going back further to the past in time series. On the other hand, if the determination result of step 1304 is affirmative, at step 1305 the CPU 21 stores information indicating the latest-found zero-cross point that has made the absolute value of the difference within the allowable range in the RAM 23 as a loop start-point between loop points of the audio data (the other loop point is a loop end-point). In the embodiment, a time corresponding to the latest-found zero-cross point (loop start-point time) is stored as information indicating the loop start-point. As described later, in the embodiment, each piece of regular key push timing synchronizes with a zero-cross point of a prescribed phase (a rise phase, a negative-to-positive data value change). Therefore, the loop end-point is a point corresponding to regular key push timing. Therefore, in the embodiment, a time corresponding to regular key push timing (loop end-point time) is stored as information indicating the loop end-point.

Then, at step 1306, the CPU 21 sets the loop playing flag of the register group 610 to "2." The loop playing flag indicates a loop playing state of audio data. The loop playing flag being "2" means a loop playing start state. On the other hand, the loop playing flag being "1" means a loop playing state, and the loop playing flag being "0" means a state that no loop playing is being performed.

Figure 14:
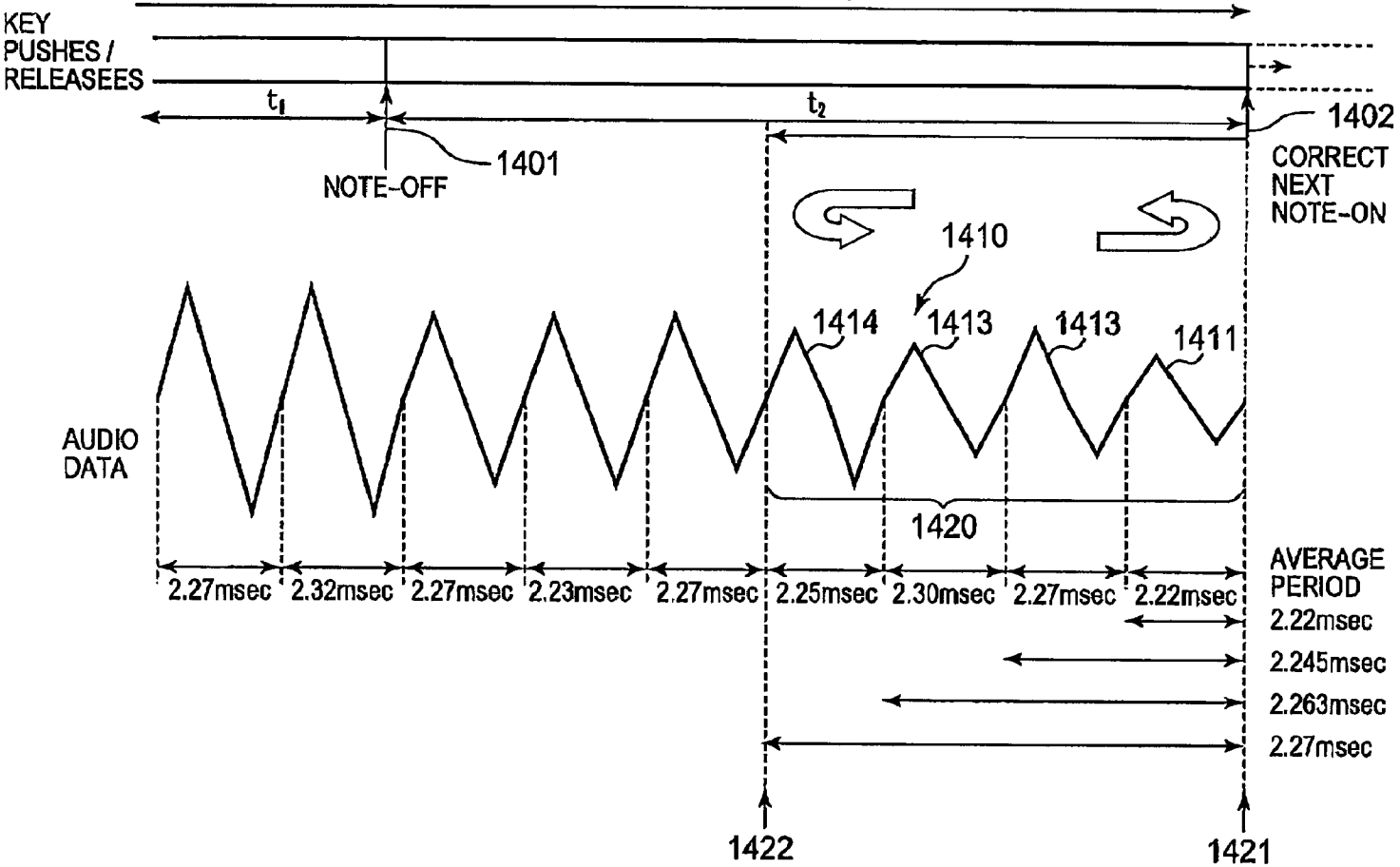
FIG. 14 illustrates an example of detection of loop points according to the embodiment.

FIG. 14 illustrates an example of detection of loop points according to the embodiment. In FIG. 14, symbol 1401 indicates note-off (key release) timing and symbol 1402 indicates correct next note-on (key push) timing. The time-period from note-on of a certain key to the next note-on is Δt (indicated by symbol 1400). Symbol 1410 denotes audio data for an accompaniment. The pitch of the key that has already been pushed and from which a finger has already been released (indicated by symbol 1401) is A4 (=440 Hz) and its loop period is about 2.27 ms.

Referring to FIG. 14, if a key push is not done actually at the correct next note-on timing 1402, the CPU 21 measures periods between zero-cross points (of the same phase) of audio data. In the first processing, a pair of zero-cross points are determined by going back to the past in time series from the correct next note-on timing 1402 and the average period of a waveform 1411 between those zero-cross points is 2.22 ms. For example, in the embodiment, if the threshold value for the pitch A4 is 0.01 ms, the determination result of step 1304 (see FIG. 13) becomes negative because |2.27−2.22| is larger than or equal to the threshold value. At the next step 1302, the CPU 21 goes back further in time series, whereby two pairs of zero-cross points are determined in total.

The average period of the two waveforms 1411 and 1412 between the determined zero-cross points is calculated as 2.245 ms. The process returns to step 1302 again because |2.27−2.245| is still larger than or equal to the threshold value. At the step 1302, the CPU 21 goes back further in time series, whereby three pairs of zero-cross points are determined in total. The average period of the three waveforms 1411-1413 between the determined zero-cross points is calculated as 2.263 ms. The process returns to step 1302 again because |2.27−2.263| is still larger than or equal to the threshold value.

At the step 1302, the CPU 21 goes back further in time series, whereby four pairs of zero-cross points are determined in total. The average period of the four waveforms 1411-1414 between the determined zero-cross points is calculated as 2.27 ms. The determination result of step 1304 becomes affirmative because |2.27−2.27| is smaller than the threshold value. The time-period 1420 consisting of the four waveforms 1411-1414 is a loop time-period and its start point 1422 and end point 1421 are loop points. In the embodiment, the start point 1422 and the end point 1421 correspond to a loop start-point time and a loop end-point time, respectively.

In this manner, a time-period having waveforms whose average period matches the pitch of a musical sound being generated is obtained and these waveforms in this time-period are read out repeatedly, whereby an accompaniment sound that is not uncomfortable to the player can be output.

Figure 15:
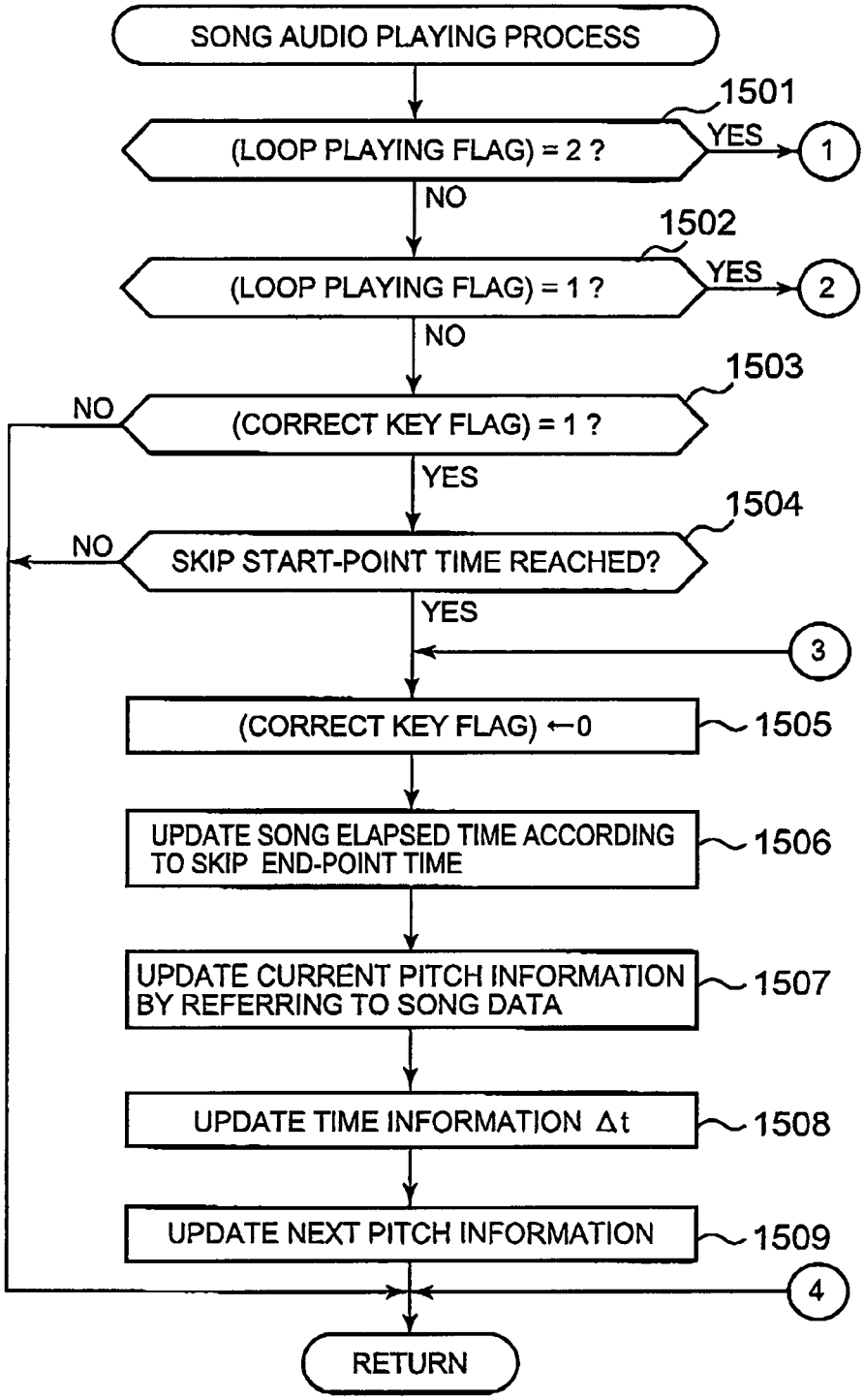
FIG. 15 is a flowchart of an example song audio playing process according to the embodiment.
Figure 16A:
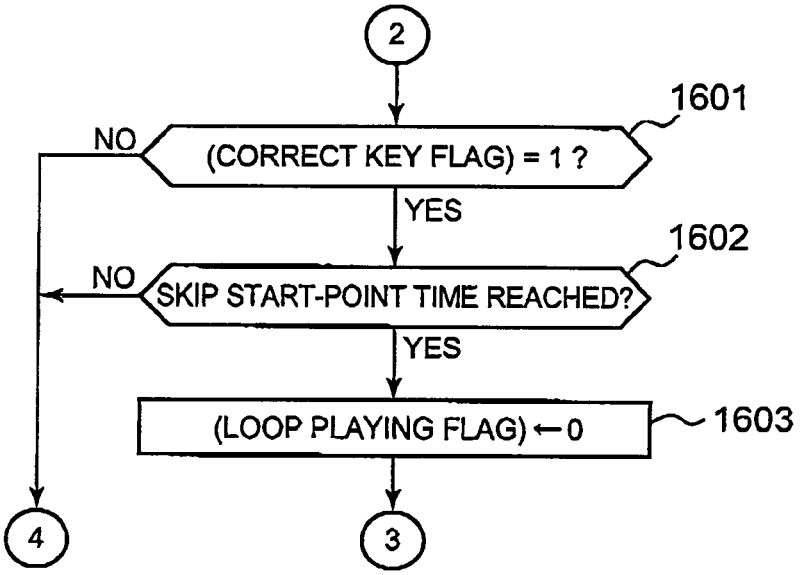
FIGS. 16A and 16B are flowcharts of example song audio playing processes according to the embodiment.
Figure 16B:
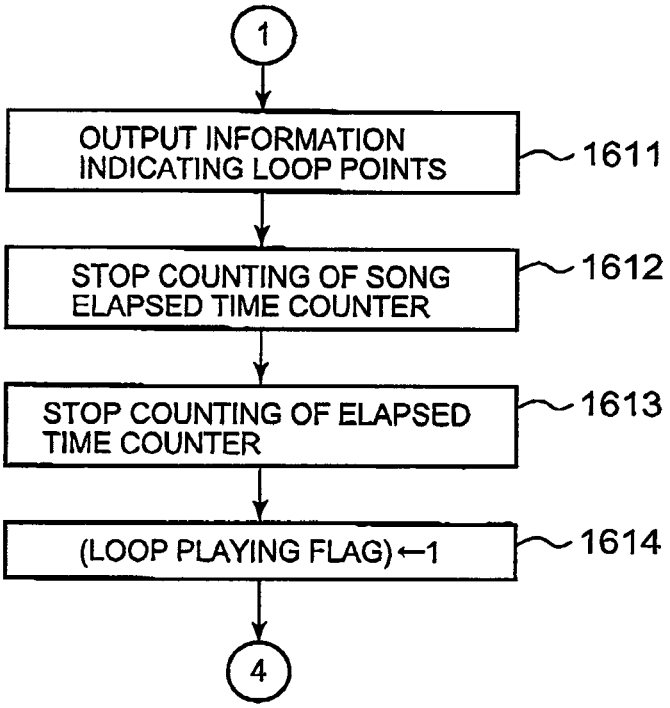

Upon completion of step 1004 (song musical sound playing process), the CPU 21 executes a song audio playing process at step 1005. FIG. 15 and FIGS. 16A and 16B are flowcharts of an example song audio playing process. As shown in FIG. 15, at step 1501, the CPU 21 determines whether or not the loop playing flag is "2." The loop playing flag being "2" means a loop playing start state. If the determination result of step 1501 is affirmative, the process moves to step 1611 shown in FIG. 16B. If the determination result of step 1501 is negative, at step 1502 the CPU 21 determines whether or not the loop playing flag is "1." The loop playing flag being "1" means a loop playing state. If the determination result of step 1502 is affirmative, the process moves to step 1601 shown in FIG. 16A.

If the determination result of step 1502 is negative, that is, if the loop playing flag is "0" (no loop playing is being performed), at step 1503 the CPU 21 determines whether or not the correct key flag is "1." If the determination result of step 1503 is negative, the song audio playing process is finished. If the determination result of step 1503 is affirmative, it means that the player pushed the key concerned earlier than its regular push timing (early push). In this case, at step 1504, the CPU 21 determines whether or not the skip start-point time has been reached by referring to the elapsed time counter. If the determination result of step 1504 is negative, the song audio playing process is finished.

The skip start-point time is a zero-cross point that is closest to the key push timing on its future side in time series. Therefore, in the embodiment, a connection point of the audio data can be smoothed out by detecting zero-cross points. If the determination result of step 1504 is affirmative, at step 1505 the CPU 21 resets the correct key flag to "0." At step 1506, the CPU 21 updates the song elapsed time according to the skip end-point time. That is, the audio data can be played so as to have a smooth connection point and to be adjusted to the early push of the player by equalizing the skip start-point time with regular key push timing (which corresponds to a skip end-point time according to the embodiment) of a key to be pushed next. Then, at steps 1507-1509, the CPU 21 updates the current pitch information, time information Δt, and the next pitch information, respectively, by referring to the song data.

Next, the process which is executed if the determination result of step 1502 is affirmative will be described. If the determination result of step 1502 is affirmative, it means that loop playing has already been started. In this case, at step 1601 the CPU 21 determines whether or not the correct key flag is "1." If the determination result of step 1601 is negative, the song audio playing process is finished.

If the determination result of step 1601 is affirmative, it means that the player pushed the subject key later than its regular key push timing (late push). If the determination result of step 1601 is affirmative, at step 1602 the CPU 21 determines whether or not the skip start-point time has been reached by referring to the elapsed time counter. If the determination result of step 1602 is negative, the song audio playing process is finished. If the determination result of step 1602 is affirmative, at step 1603 the CPU 21 resets the loop playing flag to "0." Then, steps 1505-1509 are executed.

Next, the process which is executed if the determination result of step 1501 is affirmative will be described. If the determination result of step 1501 is affirmative, at step 1611 the CPU 21 outputs, to the audio data player 29, pieces of information indicating the two loop points (loop start-point time and loop end-point time) that were set at step 1305 shown in FIG. 13. At step 1612, the CPU 21 stops the counting of the song elapsed time counter of the timer interrupt process. At step 1613, the CPU 21 stops the counting of the elapsed time counter. Steps 1612 and 1613 are executed because during the loop playing the audio data is loop-played between the loop start-point time and the loop end-point time and the song data does not advance. At step 1614, the CPU 21 sets the loop playing flag to "1." Then, the song audio playing process 1005 is finished.

Upon completion of the song process (step 704), the CPU 21 executes a sound source sound generation process at step 705. FIG. 17 is a flowchart of an example sound source sound generation process according to the embodiment. In the sound source sound generation process shown in FIG. 17, steps 1701-1712 are executed by the audio data player 29 according to instructions from the CPU 21 and received pieces of information. Step 1713 is executed by the sound source section 26.

As shown in FIG. 17, at step 1701, the audio data player 29 determines whether or not the loop playing flag is "1." If the determination result of step 1701 is negative, the audio data is read out ordinarily. That is, at step 1702, the audio data player 29 determines whether or not a data read time that is determined by a sampling rate has been reached. If the determination result of step S1702 is affirmative, at step 1703 the audio data player 29 reads out part of the audio data based on a data read address for the audio data. At step 1704, the audio data player 29 outputs the read-out data to the audio circuit 27. At step 1705, the audio data player 29 increments the data read address of the audio data area.

If the determination result of step 1701 is positive, at step 1706 the audio data player 29 determines whether or not the data read address for the audio data has reached a value corresponding to the loop end-point time. If the determination result of step 1706 is affirmative, at step 1707 the audio data player 29 changes the data read address to a value corresponding to a loop start-point time.

At step 1708, the audio data player 29 determines whether or not a data read time that is determined by the sampling rate has been reached. If the determination result of step S1708 is affirmative, at step 1709 the audio data player 29 reads out part of the audio data based on a data read address for the audio data. At step 1710, the audio data player 29 multiplies the read-out data by an envelope which attenuates with time. At step 1711, the audio data player 29 outputs multiplied data to the audio circuit 27. At step 1712, the audio data player 29 increments the data read address of the audio data area.

When the ordinary audio data playing or the audio data loop playing has been performed in the above-described manner, at step 1713 the sound source section 26 executes a musical data sound generation process. Naturally, steps 1701-1712 and step 1713 may be executed parallel. At step 1713 (musical data sound generation process), if having received a note-on event from the CPU 21, the sound source section 26 reads waveform data having a tone that conforms to the note-on event at a rate that conforms to the note-on event, multiplies the read-out waveform data by a prescribed envelope, and outputs multiplied data to the audio circuit 27. If having received a note-off event, the sound source section 26 mutes data having a pitch that conforms to the note-off event.

Upon completion of the sound source sound generation process (step 705), the CPU 21 executes other processes (e.g., display of an image on the display unit 15) at step 706. Then, the main process returns to step 702.

Figure 18:
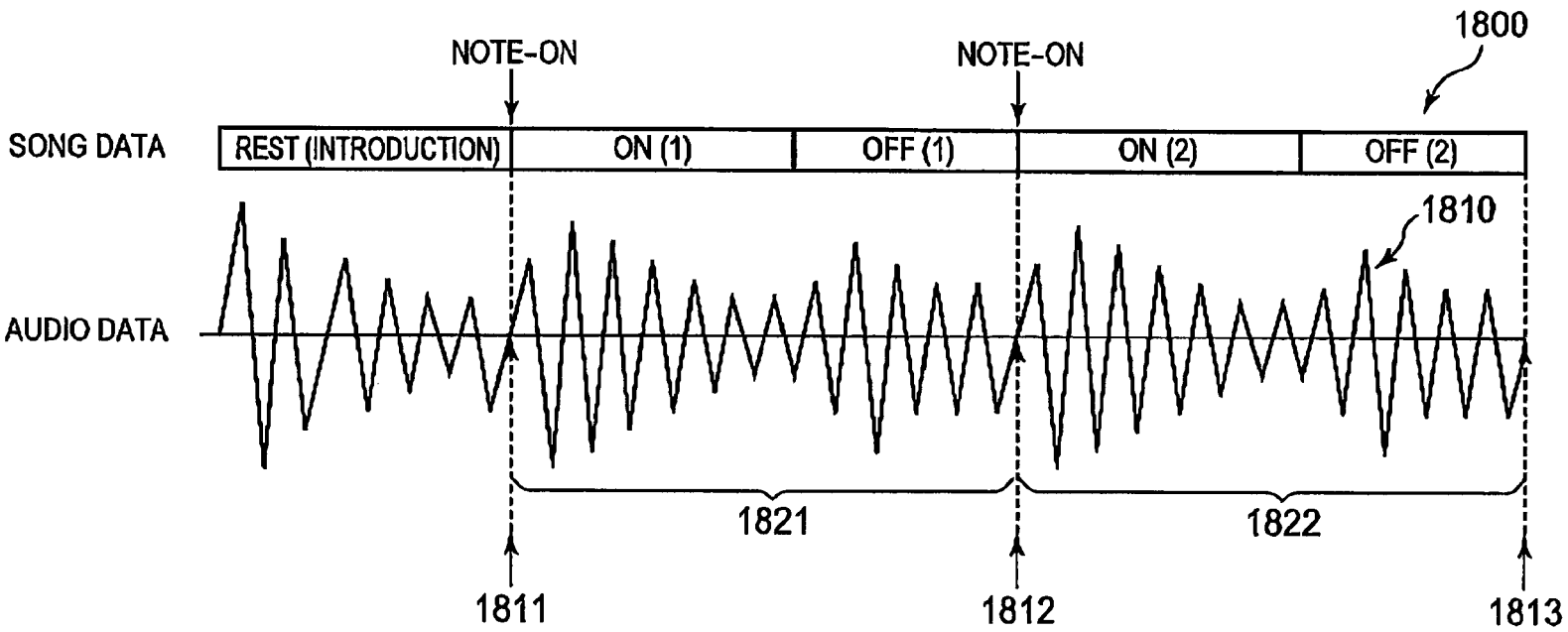
FIG. 18 shows an example relationship between key push (note-on)/key release (note-off) timing of song data and audio data in the embodiment.
Figure 19:
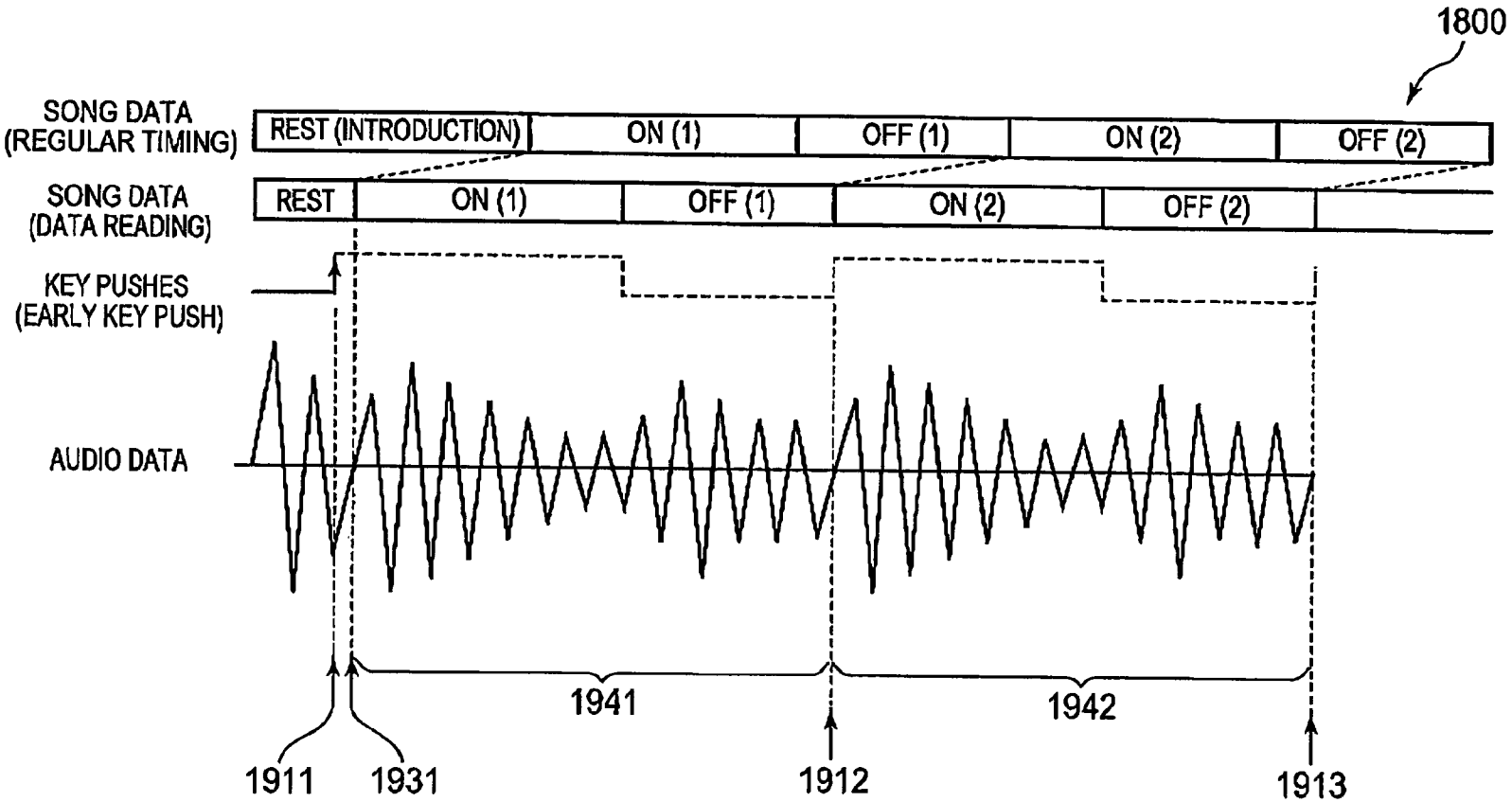
FIG. 19 shows a similar example relationship to the example relationship of FIG. 18 in a case that a player makes an early push.

FIG. 18 shows an example relationship between key push (note-on)/key release (note-off) timing of song data and audio data in the embodiment. FIG. 19 shows a similar example relationship in a case that a player makes an early push. As shown in FIG. 18, in the embodiment, pieces of key push timing of song data 1800 is set in advance so as to synchronize with zero-cross points (indicated by symbols 1811-1813) of a prescribed phase (in this example, the data value changes from negative to positive) of audio data 1810. In this example, a waveform 1821 between a key push (indicated by symbol 1811) at first regular key push timing and a key push (indicated by symbol 1812) at the next regular key push timing is delimited by zero-cross points having the same phase. Likewise, a waveform 1822 between the next pair of key pushes (indicated by symbols 1812 and 1813) at the corresponding pieces of regular key push timing is delimited by zero-cross points having the same phase. Although in the embodiment each piece of regular key push timing is set so as to synchronize with a zero-cross point of a prescribed phase of audio data, the invention is not limited to such a case.

In the example of FIG. 19, a player makes a first key push (indicated by symbol 1911) earlier than the regular timing. In this case, a zero-cross point (indicated by symbol 1931) that is closest to the key push timing of the player on its future side in time series is found in the audio data And a waveform 1941 between the key push (indicated by symbol 1811 in FIG. 18) at the first regular key push timing and the key push (indicated by symbol 1812 in FIG. 18) at the next regular key push timing is connected to the waveform before the thus-found zero-cross point. In FIG. 19, the waveform 1941 between the two pieces of timing 1931 and 1912 is the same as the waveform 1821 shown in FIG. 18, and a waveform 1942 between the two pieces of timing 1912 and 1913 is the same as the waveform 1822 shown in FIG. 18.

As described above, in the embodiment, if a player makes an early push, a zero-cross point that is closest to the key push timing of the player on its future side in time series is found in audio data and audio data whose data value starts from zero and that corresponds to regular pieces of key push timing is connected to the waveform before the thus-found zero-cross point and then played. Therefore, even if a key push is made earlier than regular key push timing, audio data is read out so as to be adjusted to the early key push. The connection point is smooth and hence no uncomfortable noise is generated.

If a player does not make a key push for a certain pieces of regular key push timing, as described above with reference to FIG. 14, audio data is loop-played between a loop start-point time (1422) and a loop end-point time (1421) while no key push is made. If the player then pushes the key concerned, the audio data read address is switched from an address of a skip start-point time that is closest to the key push timing on its future side in time series to an address of a skip end-point time that is a time corresponding to the regular key push timing of the key pushed. Therefore, as in the case of an early key push, audio data is read out so as to be adjusted to the late key push. The connection point is smooth and hence no uncomfortable noise is generated.

Although in the embodiment audio data is configured so that each piece of regular key push timing synchronizes with a zero-cross point of a prescribed phase, the invention is not limited to such a case. Where audio data is not configured in this manner, a zero-cross point of a prescribed phase that is closest to regular key push timing of a key concerned on its future side in time series may be used as a skip end-point time.

In the embodiment, if determining that a key has been pushed earlier than its sound generation timing prescribed in song data, the CPU 21 finds, in audio data, a first zero-cross point of a prescribed phase that is closest to the key push timing in one direction in time series. Then, the CPU 21 finds a second zero-cross point of the prescribed phase that is closest, in the one direction, in time series, to regular sound generation timing of song data corresponding to the key push manipulation. The CPU 21 outputs information of the first zero-cross point and information of the second zero-cross point to the audio data player 29. The audio data player 29 causes the audio data read address to skip from an address of the first zero-cross point to an address of the second zero-cross point and thereafter continues ordinary audio data reading.

With this measure, even if an early key push occurs, audio data corresponding to its regular sound generation timing (key push timing) can be played, whereby occurrence of a deviation between the key push of the player and audio data playing can be prevented. Since audio data obtained by connecting zero-cross points having the same phase is read out, generation of noise at the audio data connection point can be prevented.

In the embodiment, when the audio data read address is caused to skip from an address of the first zero-cross point to an address of the second zero-cross point, the CPU 21 updates the elapsed time to one that is based on the regular sound generation timing and the audio data player 29 reads out audio data according to the updated elapsed time. In this manner, even if a player makes an early key push, the elapsed time can be adjusted properly.

In the embodiment, the CPU 21 finds a first zero-cross point that is closest to key push timing on its future side in time series and finds a second zero-cross point that is closest to regular sound generation timing corresponding to the key push on its future side in time series. Finding, as a first zero-cross point, a zero-cross point that is closest to key push timing on its future side in time series enables a proper transition from the first zero-cross point to a second zero-cross point taking processing time into consideration.

In particular, in the embodiment, each piece of sound generation timing (key push timing) of song data corresponds to a zero-cross point having a prescribed phase of audio data. The CPU 21 detects a second zero-cross point of the prescribed phase that corresponds to regular sound generation timing (key push timing) This makes it possible to easily detect second key push timing.

The invention is not limited to the above embodiment. For example, in the embodiment, plural waveforms are determined whose average period is approximately equal to a loop period that is calculated based on the pitch information (current pitch information) of a musical sound being generated However, the invention is limited to such a case. For example, where song data is associated with chord names, an average period of waveforms of audio data may be compared with a loop period that is calculated based on the root of a chord that is correlated with a musical sound being generated.

Figure 20:
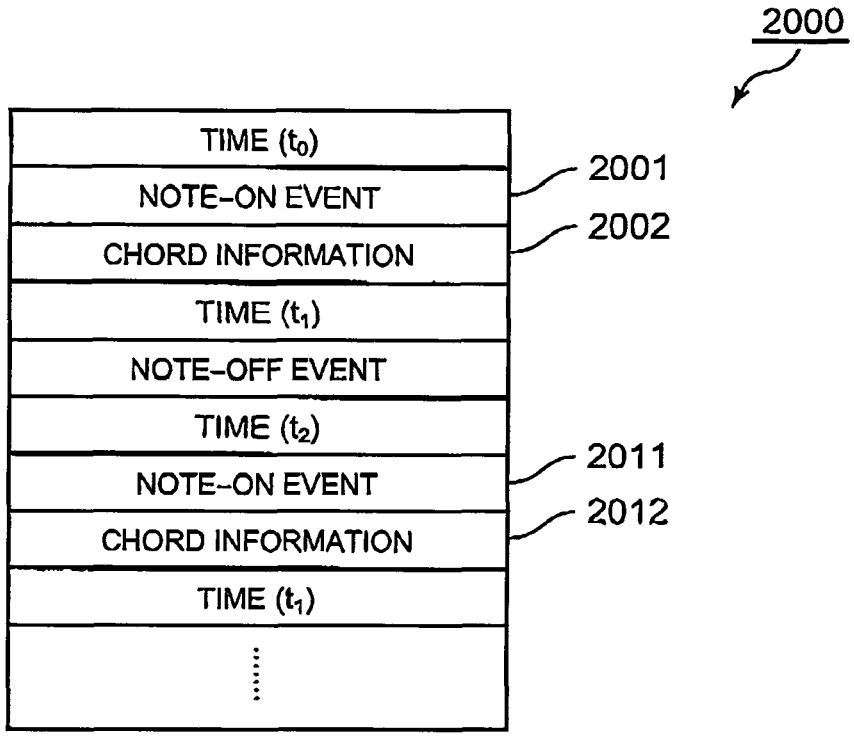
FIG. 20 shows an example data structure of song data according to another embodiment of the invention.

FIG. 20 shows an example data structure of song data according to another embodiment of the invention. As shown in FIG. 20, in this embodiment, records of pieces of chord information 2002, 2012, etc. are provided so as to be correlated with records 2001, 2011, etc. of note-on events of song data 2000, respectively. Each piece of chord information includes information indicating a root such as CM7, Cm7, Am7, D7, or the like.

Figure 21:
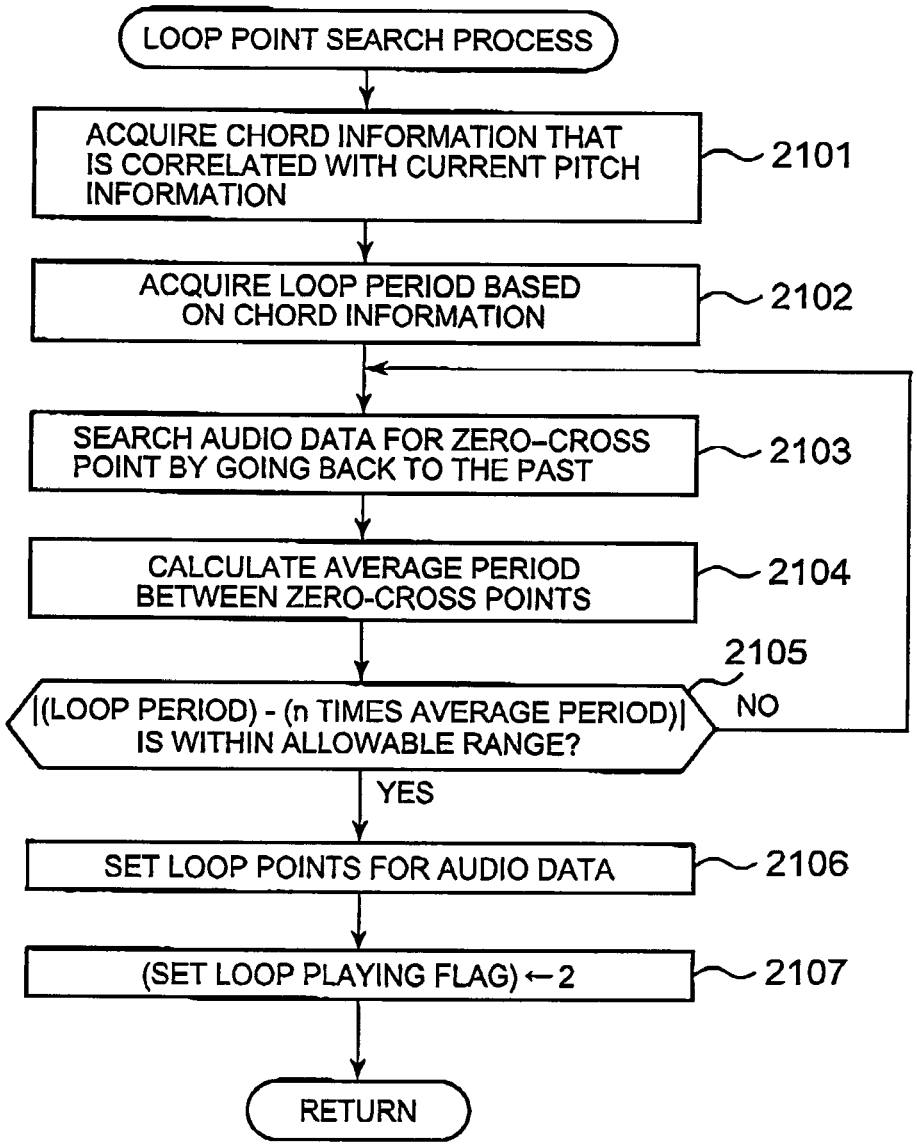
FIG. 21 is a flowchart of an example loop point search process according to the other embodiment.

FIG. 21 is a flowchart of an example loop point search process according to this embodiment. As shown in FIG. 21, at step 2101, the CPU 21 acquires, from song data, chord information that is correlated with the current pitch information in the current pitch information register. At step 2102, the CPU 21 calculates a loop period which is a period of the root included in the acquired chord information. If the chord information has a root A as in the case of AM7, Am7, or the like, a loop period is calculated as 4.5454 ms based on a pitch A3 (220 Hz), for example. In this embodiment, a loop period is calculated based on a relatively low pitch taking octaves into consideration.

Steps 2103 and 2104 are the same as steps 1302 and 1303 shown in FIG. 13. At step 2105, the CPU 21 the CPU 21 determines whether or not the absolute value of the difference between the loop period and the average period multiplied by n (n=1, 2, 4) is within an allowable range (i.e., smaller than a prescribed threshold value). In step 2105, the probability that the musical sound concerned of the audio data is one or two octaves higher than the root is taken into consideration.

If the determination result of step 2105 is negative, the CPU 21 searches the audio data for the next zero-cross point by going back further to the past in time series. On the other hand, if the determination result of step 2105 is affirmative, at step 2106 the CPU 21 stores information indicating the latest-found zero-cross point that has made the absolute value of the difference within the allowable range in the RAM 23 as a loop start-point between loop points of the audio data. At step 2107, the CPU 21 sets the loop playing flag to "2."

While the present invention has been shown and described with reference to certain exemplary embodiments thereof, it will be understood by those skilled in the art that various changes in form and details may be made therein without departing from the spirit and scope of the invention as defined by the appended claims. It is aimed, therefore, to cover in the appended claim all such changes and modifications as fall within the true spirit and scope of the present invention.

What is claimed is:

1. A musical sound generation instrument, comprising:

a storage unit configured to store song data and audio data therein, wherein (a) the song data includes pitches and time information indicating sound generation timing of musical sounds of a song, and (b) the audio data is accompaniment data for the song of the song data;

a musical sound data generator configured to generate musical sound data of prescribed musical sounds, based on manipulations of a plurality of playing elements; and an audio data player configured to read and play the audio data according to elapsed time information obtained based on the time information included in the song data;

wherein the audio data player comprises:

a manipulation judging unit configured to determine whether manipulation timing of one of the playing elements synchronizes with the sound generation timing of the song data; and a player controller configured, when the manipulation judging unit determines that the manipulation timing does not synchronize with the sound generation timing, to (a) change a reading position of the audio data from a zero-cross point corresponding to the manipulation timing to a zero-cross point corresponding to the sound generation timing, and then (b) read and play the audio data from the changed reading position of the audio data.

2. The musical sound generation instrument of claim 1, wherein the manipulation judging unit is configured to determine whether the manipulation timing is earlier than the sound generation timing, and wherein the player controller comprises:

a skip start-point detector configured, when the manipulation judging unit determines that the manipulation timing is earlier than the sound generation timing, to detect a first zero-cross point in the audio data, wherein the first zero-cross point has a predetermined phase and is closest to the manipulation timing in time series;

a skip end-point detector configured to detect a second zero-cross point in the audio data, wherein the second zero-cross point has the predetermined phase and is closest to a timing that corresponds to a correct sound generation timing of the musical sound that is indicated by the manipulation of the playing element in time series of the song data; and a reading controller configured to (a) change the reading position of the audio data from the first zero-cross point to the second zero-cross point, and then (b) read and play the audio data from the changed reading position of the audio data.

3. The musical sound generation instrument of claim 2, wherein the audio data player (a) makes an update to the elapsed time information based on the second zero-cross point and (b) reads the audio data according to the updated elapsed time information, when the reading controller changes the reading position of the audio data from the first zero-cross point to the second zero-cross point.

4. The musical sound generation instrument of claim 2, wherein the skip start-point detector is configured to detect the first zero-cross point that is closest to the manipulation timing in future time, and the skip end-point detector is configured to detect the second zero-cross point that is closest to the correct sound generation timing in future time.

5. The musical sound generation instrument of claim 2, wherein the first zero-cross point and the second zero-cross point have the same phase of the audio data.

6. The musical sound generation instrument of claim 1, wherein the manipulation judging unit is configured to determine whether any one of the playing elements has failed to have been manipulated by the sound generation timing, and wherein the player controller comprises:

a loop end-point detector configured, when the manipulation judging unit determines that the playing element has failed to have been manipulated by the sound generation timing, to detect a first zero-cross point in the audio data, wherein the first zero-cross point is closest to a timing that corresponds to a correct sound generation timing of the musical sound that failed to be generated by failure to manipulate the playing element in time series of the song data;

a loop start-point detector configured, when the manipulation judging unit determines that the playing element has failed to have been manipulated by the sound generation timing, to detect a second zero-cross point in the audio data, wherein the second zero-cross point is located at an edge point of a time period that is proportional to a period that matches the pitch of the musical sound, among zero-cross points prior to the first zero-cross point;

a loop reader configured to repeatedly read the audio data existing in a loop time-period that is defined by a time-period between the second zero-cross point and the first zero-cross point;

a skip start-point detector configured, when the manipulation judging unit determines that the playing element has been manipulated after the loop reader starts to read the audio data, to detect a third zero-cross point in the audio data, wherein the third zero-cross point is closest to the manipulation timing in time series; and a reading controller configured to (a) change the reading position of the audio data from the third zero-cross point to the first zero-cross point, and then (b) read and play the audio data from the changed reading position of the audio data.

7. The musical sound generation instrument of claim 6, wherein the audio data player (a) makes an update to the elapsed time information based on the first zero-cross point and (b) reads the audio data according to the updated elapsed time information, when the reading controller changes the reading position of the audio data from the third zero-cross point to the first zero-cross point.

8. The musical sound generation instrument of claim 6, wherein the skip start-point detector is configured to detect the third zero-cross point that is closest to the manipulation timing in future time, and the loop end-point detector is configured to detect the first zero-cross point that is closest to the correct sound generation timing in future time.

9. The musical sound generation instrument of claim 6, wherein the first zero-cross point, the second zero-cross point, and the third zero-cross point have the same phase of the audio data.

10. A non-transitory computer-readable storage medium storing a program for controlling a control unit of a musical sound generation instrument that includes: (i) a storage unit configured to store song data and audio data therein, wherein (a) the song data includes pitches and time information indicating sound generation timing of musical sounds of a song, and (b) the audio data is accompaniment data for the song of the song data; and (ii) a musical sound data generator configured to generate musical sound data of prescribed musical sounds, based on manipulations of a plurality of playing elements, and wherein the program controls the control unit to perform functions comprising:

determining whether manipulation timing of one of the playing elements synchronizes with the sound generation timing of the song data;

when it is determined that the manipulation timing does not synchronize with the sound generation timing, changing a reading position of the audio data from a zero-cross point corresponding to the manipulation timing to a zero-cross point corresponding to the sound generation timing; and reading and playing the audio data from the changed reading position of the audio data.

* * * * *